US007183720B2

(12) United States Patent
Kobayashi

(10) Patent No.: US 7,183,720 B2
(45) Date of Patent: Feb. 27, 2007

(54) PLASMA DISPLAY PANEL, PLASMA DISPLAY APPARATUS AND METHOD OF DRIVING THE SAME

(75) Inventor: Koji Kobayashi, Tokyo (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/895,287

(22) Filed: Jul. 21, 2004

(65) Prior Publication Data

US 2005/0017652 A1 Jan. 27, 2005

(30) Foreign Application Priority Data

Jul. 22, 2003 (JP) ..... 2003-277849

(51) Int. Cl.
*G09G 3/10* (2006.01)

(52) U.S. Cl. ..... 315/169.4; 313/585; 345/60

(58) Field of Classification Search ..... 315/169.1, 315/169.3, 169.4, 582, 585, 586, 587; 345/60, 345/67

See application file for complete search history.

(56) References Cited

U.S. PATENT DOCUMENTS

| | | | | |
|---|---|---|---|---|
| 6,479,932 | B1 * | 11/2002 | Nunomura | 313/582 |
| 6,744,413 | B2 * | 6/2004 | Nunomura | 345/60 |
| 6,819,046 | B2 * | 11/2004 | Hirano | 313/582 |
| 2005/0017652 | A1 * | 1/2005 | Kobayashi | 315/169.3 |

FOREIGN PATENT DOCUMENTS

| | | |
|---|---|---|
| JP | 9-120777 A | 5/1997 |
| JP | 09-160525 | 6/1997 |
| JP | 2000-323038 | 11/2000 |

(Continued)

OTHER PUBLICATIONS

Japanese Patent Application No. 2004-194336 mailing date Sep. 27, 2005.
Japanese Patent Application No. 2004-194336 mailing date May 19, 2006.

*Primary Examiner*—Tuyet Vo
*Assistant Examiner*—Jimmy Vu
(74) *Attorney, Agent, or Firm*—Sughrue Mion, PLLC

(57) ABSTRACT

A plasma display panel of an AC 3-electrode plane discharge type includes a front substrate and a back substrate. A plurality of sets of plane discharge electrodes are formed on the front substrate to extend to a row direction, and a plurality of address electrodes formed on the back substrate to extend a column direction. A plurality of row separation walls are formed on the back substrate and the plurality of address electrodes to extend in the row direction, and a plurality of column separation walls are formed on the back substrate to extend in the column direction. A plurality of discharge cells are arranged in matrix. Each of the plurality of discharge cells is defined by adjacent two of the plurality of row separation walls and adjacent two of the plurality of column separation walls, and each of rows of the plurality of discharge cells is associated with one of the plurality of sets of plane discharge electrodes and each of columns of the plurality of discharge cells is associated with one of the plurality of address electrodes. Each of the plurality of sets contains a first plane discharge electrode and a second plane discharge electrode. The first plane discharge electrode is provided above a corresponding one of the plurality of row separation walls and a corresponding one of the rows of the plurality of discharge cells, and the second plane discharge electrode is provided above the corresponding one of the rows of the plurality of discharge cells.

19 Claims, 32 Drawing Sheets

FOREIGN PATENT DOCUMENTS

| | | |
|---|---|---|
| JP | 2002-216639 | 8/2002 |
| JP | 2003-323848 | 11/2003 |
| JP | 2003-331741 | 11/2003 |
| JP | 2004-362987 | 12/2004 |

* cited by examiner

SUBFIELD (SF)
RESET PERIOD
ADDRESS PERIOD
SUSTAIN PERIOD

SUSTAIN ELECTRODE (COMMON ELECTRODE) C 111-1~111-m

SCAN ELECTRODE S 112-1
Vsp
Vsb

SCAN ELECTRODE S 112-2

SCAN ELECTRODE S 112-3

SCAN ELECTRODE S 112-(m-2)

SCAN ELECTRODE S 112-(m-1)

SCAN ELECTRODE S 112-m

ADDRESS ELECTRODE D 107-1~107-n
Vdp

SUBFIELD (SF)
RESET PERIOD
ADDRESS PERIOD
SUSTAIN PERIOD

SUSTAIN ELECTRODE (COMMON ELECTRODE) C 11-1~11-m

SCAN ELECTRODE S 12-1
Vsp
Vsb

SCAN ELECTRODE S 12-2

SCAN ELECTRODE S 12-3

SCAN ELECTRODE S 12-(m-2)

SCAN ELECTRODE S 12-(m-1)

SCAN ELECTRODE S 12-m

ADDRESS ELECTRODE D 7-1~7-n
Vdp

SUBFIELD (SF)
RESET PERIOD
ADDRESS PERIOD
SUSTAIN PERIOD

SUSTAIN ELECTRODE (COMMON ELECTRODE) C 11-1~11-m

SCAN ELECTRODE S 12-1
Vsp
Vsb

SCAN ELECTRODE S 12-2

SCAN ELECTRODE S 12-3

SCAN ELECTRODE S 12-4

SCAN ELECTRODE S 12-(m-3)

SCAN ELECTRODE S 12-(m-2)

SCAN ELECTRODE S 12-(m-1)

SCAN ELECTRODE S 12-m

ADDRESS ELECTRODE D 7-1~7-n
Vdp

SUBFIELD (SF)
RESET PERIOD
ADDRESS PERIOD
SUSTAIN PERIOD

SUSTAIN ELECTRODE (COMMON ELECTRODE) C 11-1~11-m

SCAN ELECTRODE S 12-1
Vsp
Vsb

SCAN ELECTRODE S 12-2

SCAN ELECTRODE S 12-3

SCAN ELECTRODE S 12-4

SCAN ELECTRODE S 12-(m-3)

SCAN ELECTRODE S 12-(m-2)

SCAN ELECTRODE S 12-(m-1)

SCAN ELECTRODE S 12-m

ADDRESS ELECTRODE D 7-1~7-n
Vdp

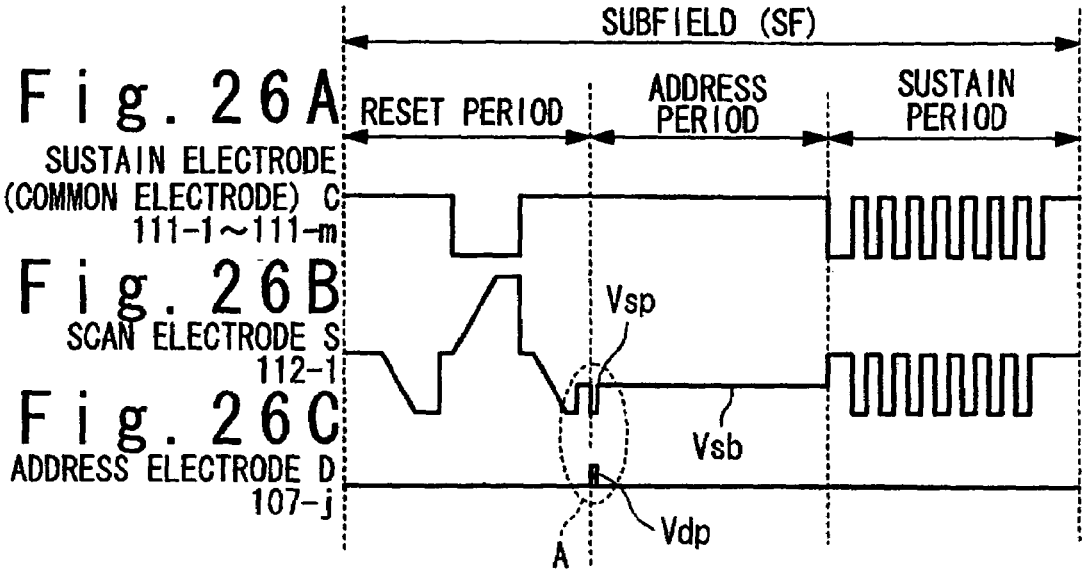
Fig. 26A
Fig. 26B
Fig. 26C
SUBFIELD (SF)
RESET PERIOD
ADDRESS PERIOD
SUSTAIN PERIOD
SUSTAIN ELECTRODE (COMMON ELECTRODE) C 111-1~111-m
SCAN ELECTRODE S 112-1
ADDRESS ELECTRODE D 107-j
Vsp
Vsb
Vdp
A
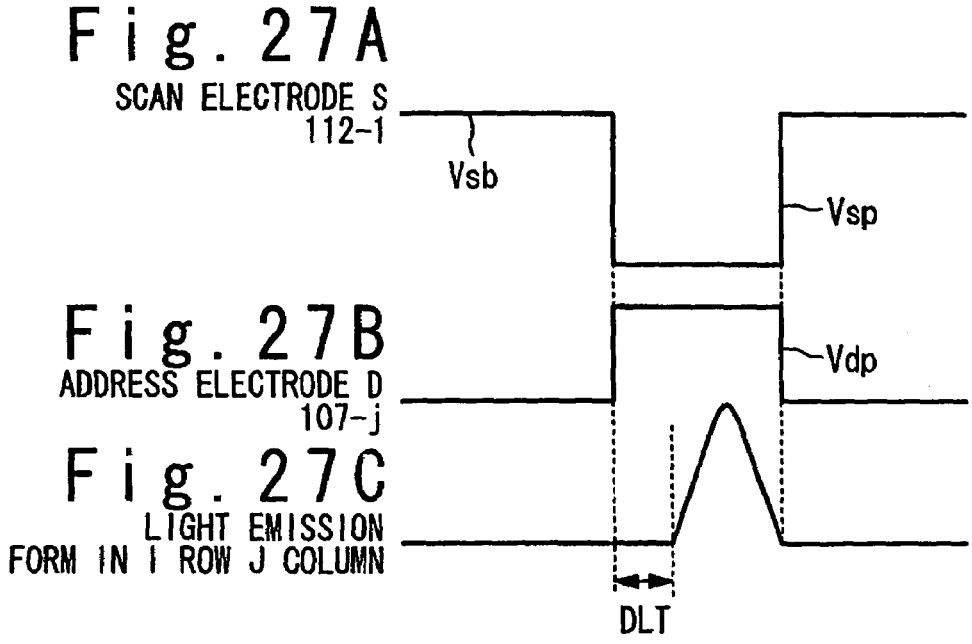
Fig. 27A
Fig. 27B
Fig. 27C
SCAN ELECTRODE S 112-1
ADDRESS ELECTRODE D 107-j
LIGHT EMISSION FORM IN I ROW J COLUMN
Vsb
Vsp
Vdp
DLT

SUBFIELD (SF)

RESET PERIOD
ADDRESS PERIOD
SUSTAIN PERIOD
SUSTAIN ELECTRODE (COMMON ELECTRODE) C
111-1~111-m

Vsp
SCAN ELECTRODE S
112-1

Vsb
ADDRESS ELECTRODE D
107-j
A
Vdp

PLASMA DISPLAY PANEL, PLASMA DISPLAY APPARATUS AND METHOD OF DRIVING THE SAME

BACKGROUND OF THE INVENTION

1 Field of the Invention

The present invention relates to a plasma display panel, a plasma display apparatus using the same, and a method of driving the plasma display panel.

2. Description of the Related Art

In a color plasma display panel (PDP), a display is carried out by exciting phosphor by ultraviolet rays generated through gas discharge to emit light. A 3-electrode AC type PDP is adopted for the plasma display apparatus which is mainstream at present. The plasma display apparatus using the 3-electrode AC type PDP will be described below.

FIG. 1 shows the structure of a plasma display panel 130 of a conventional plasma display apparatus. Referring to FIG. 1, the plasma display panel 130 is composed of m sustain electrodes (C) 111-1 to **111-*m* (m is an even integer equal to or more than 2), m scan electrodes (S) 112-1 to 112-*m* extending in the same direction as the sustain electrodes, n address electrodes (D) 107-1 to 107-*n* (n is an even integer equal to or more than 2) extending in a direction orthogonal to the sustain electrodes, and (m×n) cells 121 in which discharge gas is enclosed. The (m×n) cells 121 are provided at intersections of the m sustain electrodes (C) 111-1 to 111-*m* and the m scan electrodes (S) 112-1 to 112-*m*, and the n address electrodes (D) 107-1 to 107-*n*, such that they are arranged in a matrix of m rows and n columns. A discharge gap 122 is provided between the sustain electrode (C) 111-*i* (i is an integer and $1 \leqq i \leqq m$) and the scan electrode (S) 112-*i*, and a non-discharge gap 113 is provided between the sustain electrode (C) 111-(*i*+1) and the scan electrode (S) 112-*i*, or between the sustain electrode (C) 111-*i* and the scan electrode (S) 112-(*i*+1)**.

FIG. 2 is a perspective cross sectional view showing a part of the conventional plasma display panel 130. The plasma display apparatus is further composed of a front substrate section on the display side, and a back substrate section 102. The front substrate section is composed of a front substrate 101, a transparent dielectric layer 105, and a protection layer 106. The back substrate section is composed of a back substrate 102, a dielectric layer 108, separation walls 109 and a phosphor layer 110. A glass substrate is exemplified as the front substrate 101 and the back substrate 102.

The address electrode (D) **107-*j* (j is an integer and $1 \leqq j \leqq n$) is provided on the back substrate 102 to extend into a column direction. The dielectric layer 108 is provided on the back substrate 102 to cover the address electrodes (D) 107-*j***.

The separation walls 109 are formed in a lattice form and are provided on the back substrate 102. The (m×n) cells 121 are partitioned and formed between the front substrate 101 and the back substrate 102 by the separation walls 109. Each cell 121 is formed on the address electrode (D) **107-*j*. The separation walls 109 have horizontal separation walls 109' extending to a row direction and vertical separation walls 109" extending to the column direction, for preventing crosstalk of the discharge. The horizontal separation wall 109' is orthogonal to the address electrode (D) 107-*j*. The vertical separation wall 109" is provided on the back substrate 102 in the parallel to the address electrodes (D) 107-*j*. Also, the horizontal separation walls 109' prevent the following faults. That is, the horizontal separation walls 109' prevent light emission from the cell 121 to which a write operation is not carried out, i.e., so-called miss-light. Also, when the write operation is carried out to first and second cells 121 adjacent in column direction, the horizontal separation wall 109' prevents a write fault from being caused in the second cell as the result that a wall charge accumulated in the first cell 121 when discharge is caused in the first cell 121 weakens the electric field in the second cell 121** since the wall charge acts in a direction opposite to an application voltage.

The phosphor layers 110 of red, green, and blue are formed on the dielectric layer 108 and the side surfaces of the separation walls 109, i.e., side surfaces of the horizontal separation walls 109' and vertical separation walls 109" by a screen-print method for visible light emission. The protection layer 106 is provided between the front substrate 101 and the separation wall 109. The transparent dielectric layer 105 is provided between the front substrate 101 and the protection layer 106.

FIG. 3 is a plan view showing a part of the conventional plasma display panel 130, viewing from a display side. FIG. 4 is a cross sectional view showing the conventional plasma display panel 130 along the Y1-Y2 line in FIG. 3.

The sustain electrodes (C) 111-1 to **111-*m* and the scan electrodes (S) 112-1 to 112-*m* are provided between the front substrate 101 and the transparent dielectric layer 105 to extend to the row (X) direction. Each electrode of the sustain electrodes (C) 111-1 to 111-*m* and the scan electrode (S) 112-1 to 112-*m* is constituted from a transparent electrode 103 extending to the row direction, and a bus electrode 104 extending to the row direction. The transparent electrode 103 is provided to have an area sufficient to cause discharge of a predetermined size and to improve a transmission factor of the light emitted through the discharge. The bus electrode 104 is a metal electrode connected with the transparent electrode 103 for decreasing the line resistance of the sustain electrode or scan electrode. The transparent electrodes 103 of the sustain electrodes (C) 111-1 to 111-*m* and the transparent electrodes 103 of the scan electrodes (S) 112-*i* to 112-*m* are provided above the cell 121. The bus electrodes 104 of the sustain electrodes (C) 111-1 to 111-*m* and the bus electrodes 104 of the scan electrodes (S) 112-1 to 112-*m* are provided above the cell 121 and horizontal separation walls 109'**.

More specifically, as shown in FIG. 3, a first gap is provided between the transparent electrode 103 of the sustain electrode (C) 111-1 and the transparent electrode 103 of the scan electrode (S) 112-1. The first gap is provided above the cell 121 to have a first predetermined distance corresponding to a discharge gap 122. A half of the bus electrode 104 of the sustain electrode (C) 111-2 is provided above the horizontal separation wall 109', and the other half is provided above the cell 121. Also, a half of the bus electrode 104 of the sustain electrode (C) 111-2 is provided above the horizontal separation wall 109' and the remaining half is provided above the cell 121. The transparent electrode 103 of the scan electrode (S) 112-1 on the side of the sustain electrode (C) 111-2 is provided above the horizontal separation wall 109', and is connected with the bus electrode 104 which is provided above the cell 121 and the horizontal separation wall 109'. A half portion of the scan electrode (S) 112-1 on the side of the bus electrode 104 is provided above the horizontal separation wall 109' and the remaining half portion is provided above the cell 121. A second gap is provided between the bus electrode 104 of the scan electrode (S) 112-1 and the bus electrode 104 of the sustain electrode (C) 111-2 to have a second predetermined distance corresponding to a non-discharge gap 113. The bus electrode 104 of the scan electrode (S) 112-1 and the bus electrode 104 of the sustain electrode (C) 111-2 are provided above the cell 121 and the horizontal separation wall 109' symmetrically with respect to a center line L of the horizontal separation wall 109' passing through a center point P. Thus, the center line L and the center point P of the horizontal separation wall 109' are used as a reference point to arrange the sustain electrodes (C) 111-1 to 111-*m* and the scan electrodes (S) 112-1- to 112-*m*.

Various methods are adopted to drive the AC-type PDP at present and an ADS method is a basic method. FIGS. 5A to 5H are timing charts showing the drive voltage waveforms when the conventional plasma display panel is driven by the ADS method. As shown in FIGS. 5A to 5H, in the ADS method, a period of one field or subfield is divided into a reset period, an address period, and a sustain period.

First, in the reset period, pre-discharge is carried out for the stabilization of a subsequent high-speed operation and easy write discharge. In the address period, a scan pulse voltage Vsp is sequentially applied to the scan electrodes 112-1 to 112-*m*. While the scan pulse voltage Vsp is applied to the scan electrodes 112-1 to 112-*m*, a write pulse voltage or a data pulse voltage Vdp is applied to the address electrodes 107-1 to 107-*n* to form a wall charge at an addressed cell. The data pulse voltage Vdp is a voltage corresponding to a picture data. In this address period, a write characteristic operation is carried out. The write characteristic operation is an operation that the picture data is written into the cell 121 addressed by the scan electrode (S) 112-*i* and the address electrode (D) 107-*j* so that a write discharge is carried out.

In the subsequent sustain period, a sustain voltage pulse is applied between the sustain electrode 111-*i* as a common electrode and the scan electrode 112-*i* such that the voltage of the sustain voltage pulse is lower than a discharge start voltage between these electrodes, and is larger than discharge start voltage when a voltage due to the wall charge is added. As a result, light emission is sustained.

Last, an erasure pulse is applied in the reset period and the wall electric charge is initialized.

When a gradation display is carried in the ADS method, one field is divided into a plurality of subfields and the number of the sustain pulses in each subfield is changed based on a gradation level.

When high fineness of cells is carried out in a large-scaled PDP, each discharge area of the cell becomes small. On the other hand, because there is a forming limit in the separation wall and the bus electrode width, an aperture percentage decreases so that the brightness reduces. In other words, in order to achieve the high brightness in the highly fine PDP, it is important how the aperture percentage is increased. However, when the separation wall 109 and the bus electrodes 104 are formed on a glass substrate with a large area without any fault and break, it is needed to secure the width of an extent or a forming limit. Therefore, it is generally effective to short the non-discharge gap 113 shown in FIG. 3, i.e., a distance between the bus electrodes 104 for increasing the aperture percentage.

In the structure in which the non-discharge gap is made small to the forming limit, it is necessary to secure the width of the horizontal separation wall enough to suppress interference between the neighbor cells. For example, in case that the forming limit between the bus electrodes is 80 μm and the width of the bus electrode 104 in the column direction is 60 μm, the interference between the neighbor cells can be almost suppressed if the width of the horizontal separation wall 109' is equal to or more than 100 μm in the column direction. In this case, however, a fault is caused, depending on the position relation between the separation wall and the bus electrode. Below, the position relation and the fault will be described.

FIG. 6 is a plan view showing a part of another conventional plasma display panel 130 in a case (A). FIG. 7 is a cross sectional view of the conventional plasma display panel 130 along the line Y1-Y2 of FIG. 6. In the case (A), the width of the horizontal separation wall 109' in the column direction is sufficiently larger than a first width as a summation of the non-discharge gap 113 and the width of the two bus electrodes 104 in the column direction. In this case, the transparent electrodes 103 of the sustain electrodes (C) 111-1 to 111-*m* and the scan electrodes (S) 112-1 to 112-*m* are provided above the cell 121 and the horizontal separation wall 109', and the bus electrodes 104 of the sustain electrodes (C) 111-1 to 111-*m* and the scan electrodes (S) 112-1 to 112-*m* are provided above the horizontal separation wall 109'. In the case (A), there is not interference in a vertical direction. However, the aperture percentage decreases by widening the width of the horizontal separation wall 109' in the column direction. Thus, sufficient brightness cannot be achieved.

FIG. 8 is a plan view showing a part of the conventional plasma display panel 130 in a case (B).

FIG. 9 is a cross sectional view of the conventional plasma display panel 130 along the line Y1-Y2 of FIG. 8. In the case (B), the width of the horizontal separation wall 109' in the column direction is smaller than the second width, i.e., a non-discharge gap 113. In this case, the transparent electrodes 103 and the bus electrodes 104 of the sustain electrodes (C) 111-1 to 111-*m* and the scan electrodes (S) 112-1 to 112-*m* are provided above the cell 121. In the case (B), as mentioned above, the effect which suppresses the interference in the vertical direction becomes insufficient and it is difficult to drive.

Lastly, in a case (C), as shown in FIGS. 3 and 4, the width of the horizontal separation wall 109' in the column direction is smaller than the first width and is larger than the second width. In the case (C), the aperture percentage is determined based on a summation of the non-discharge gap 113 and the width of the bus electrode 104 in the column direction. In this structure, the maximum aperture percentage is achieved and it is possible to suppress the above-mentioned vertical interference. Therefore, it is often used in the conventional plasma display apparatus. In this structure, a portion straightly below the bus electrode 104 is partially the discharge space (cell 121) and partially the horizontal separation wall 109'. This is different from the case (A)) that a portion directly blow the bus electrode 104 is the horizontal separation wall 109' and the case (B) that a portion directly below the bus electrode 104 is the discharge space (cell 121).

This difference is derived from the electric field intensity directly below the bus electrode 104. In other words, because the bus electrode 104 is thicker than the transparent electrode 103 but the transparent dielectric layer 105 is thin, the electric field intensity directly below the bus electrode 104 is stronger than the other portion. This exerts a large effect in case of drive of a plasma display panel. When the discharge space directly below the bus electrode 104 is larger, the line of electric force increases more. Therefore, in the write discharge in the address period, the discharge probability is high and stable. Also, the write discharge has the strong electric field intensity so that more wall electric charge is accumulated to cancel it. Therefore, subsequently, the discharge state is stably shifted to the sustain discharge. In other words, in order to carry out the stable drive, it is desirable that there is not the separation wall 109 but the discharge space or the cell 121 directly below the bus electrode 104.

In the case (C), the width of the horizontal separation wall 109' is smaller than the first width, i.e., the summation of the non-discharge gap 113 and the width of the two bus electrodes 104 and larger than the second width, i.e., the non-discharge gap 113. At this time, since the two substrates which have diagonals close to 1 m are mated with each other and adhered through a heating process in the PDP manufacturing method, the center point P between the bus electrodes and the center line L of the horizontal separation wall 109' are spaced by about several ten μm due to the accumulation of the mating process error and thermal contraction error in the heating process. As a result, the difference between the write properties of the cells on an odd-numbered line and an even-numbered line is caused. Also, since variation in the manufacture is not intentional, there may be a case that the odd-numbered line is superior in the write characteristic operation and the case that the even-numbered line is superior in the write characteristic operation. Thus, it is difficult to obtain the write characteristic operation which is always stable.

As a plasma display apparatus other than the plasma display panel 130, Japanese Laid Open Patent Application (JP-A-Heisei 9-120777) discloses the electrode structure of a plasma display panel which protects an erroneous discharge between adjacent cells and improves the brightness.

SUMMARY OF THE INVENTION

It is therefore an object of the present invention to provide a plasma display apparatus that is hard to receive the influence of variation in manufacture.

Another object of the present invention is to provide a plasma display apparatus that can obtain a high aperture percentage.

Still another object of the present invention is to provide a stable write characteristic operation.

Still another object of the present invention is to provide a plasma display apparatus that can reduce an electric power consumption.

Still another object of the present invention is to provide a plasma display apparatus that can obtain a high driving stability.

In an aspect of the present invention, a plasma display panel of an AC 3-electrode plane discharge type, includes a front substrate and a back substrate. A plurality of sets of plane discharge electrodes are formed on the front substrate to extend to a row direction, and a plurality of address electrodes formed on the back substrate to extend a column direction. A plurality of row separation walls are formed on the back substrate and the plurality of address electrodes to extend in the row direction, and a plurality of column separation walls are formed on the back substrate to extend in the column direction. A plurality of discharge cells are arranged in matrix. Each of the plurality of discharge cells is defined by adjacent two of the plurality of row separation walls and adjacent two of the plurality of column separation walls, and each of rows of the plurality of discharge cells is associated with one of the plurality of sets of plane discharge electrodes and each of columns of the plurality of discharge cells is associated with one of the plurality of address electrodes. Each of the plurality of sets contains a first plane discharge electrode and a second plane discharge electrode. The first plane discharge electrode is provided above a corresponding one of the plurality of row separation walls and a corresponding one of the rows of the plurality of discharge cells, and the second plane discharge electrode is provided above the corresponding one of the rows of the plurality of discharge cells.

Here, each of the first plane discharge electrode and the second plane discharge electrode may include a transparent electrode and a bus electrode connected with the transparent electrode, the bus electrode having a lower resistivity than the transparent electrode. The transparent electrode of the first plane discharge electrode is the corresponding one of the plurality of row separation walls and the corresponding one of the rows of the plurality of discharge cells. The bus electrode of the first plane discharge electrode is provided straightly above the corresponding one of the rows of the plurality of discharge cells. The second plane discharge electrode is provided straightly above the corresponding one of the rows of the plurality of discharge cells.

Also, the first plane discharge electrode may be a sustain electrode and the second plane discharge electrode may be a scan electrode. Also, the first plane discharge electrode may be a scan electrode and the second plane discharge electrode may be a sustain electrode. Instead, in an odd-numbered one of the plurality of sets, the first plane discharge electrode may be a sustain electrode and the second plane discharge electrode may be a scan electrode, and in an even-numbered one of the plurality of sets, the first plane discharge electrode may be the scan electrode and the second plane discharge electrode may be the sustain electrode. In addition, in an odd-numbered one of the plurality of sets, the first plane discharge electrode may be a scan electrode and the second plane discharge electrode may be a sustain electrode, and in an even-numbered one of the plurality of sets, the first plane discharge electrode may be the sustain electrode and the second plane discharge electrode may be the scan electrode.

Also, the transparent electrode of the first plane discharge electrode may include a first portion provided straightly above the corresponding row of the plurality of discharge cells; and a second portion provided for each of the plurality of discharge cells of the corresponding one row to connect the bus electrode of the first plane discharge electrode and the first portion.

In another aspect of the present invention, a method of driving of an AC 3-electrode plane discharge type plasma display panel is aimed, which includes a plurality of sets of a first plane discharge electrode and a second plane discharge electrode. The method may be achieved by applying a common voltage signal to one of the first and second plane discharge electrodes of each of the plurality of sets in an address period, wherein the one electrode is determined based on an arrangement of the first and second plane discharge electrodes; and by sequentially applying a write scan voltage signal to the other of the first and second plane discharge electrodes in the address period.

In this case, the applying may be achieved by applying the common voltage signal to the first plane discharge electrodes, and the sequentially applying may be achieved by sequentially applying the write scan voltage signal to all of the second plane discharge electrodes in the address period.

Also, the applying may be achieved by applying the common voltage signal to the second plane discharge electrodes, and the sequentially applying may be achieved by sequentially applying the write scan voltage signal to all of the first plane discharge electrodes in the address period.

Also, the applying may be achieved by applying the common voltage signal to the second plane discharge electrodes of odd-numbered ones of the plurality of sets and the first plane discharge electrodes of even-numbered ones of the plurality of sets, and the sequentially applying may be achieved by sequentially applying the write scan voltage signal to the first plane discharge electrodes of odd-numbered ones of the plurality of sets and then to the second plane discharge electrodes of even-numbered ones of the plurality of sets.

Also, the applying may be achieved by applying the common voltage signal to the first plane discharge electrodes of odd-numbered ones of the plurality of sets and the second plane discharge electrodes of even-numbered ones of the plurality of sets, and the sequentially applying may be achieved by sequentially applying the write scan voltage signal to the first plane discharge electrodes of even-numbered ones of the plurality of sets and then to the second plane discharge electrodes of odd-numbered ones of the plurality of sets.

In another aspect of the present invention, a plasma display apparatus of an AC 3-electrode plane discharge type, includes a plasma display panel; and a drive unit which drives the plasma display panel. The plasma display panel includes a front substrate; and a back substrate. A plurality of sets of plane discharge electrodes are formed on the front substrate to extend to a row direction, and a plurality of address electrodes are formed on the back substrate to extend a column direction. A plurality of row separation walls are formed on the back substrate and the plurality of address electrodes to extend in the row direction. A plurality of column separation walls are formed on the back substrate to extend in the column direction. A plurality of discharge cells are arranged in matrix. Each of the plurality of discharge cells is defined by adjacent two of the plurality of row separation walls and adjacent two of the plurality of column separation walls, each of rows of the plurality of discharge cells is associated with one of the plurality of sets of plane discharge electrodes and each of columns of the plurality of discharge cells is associated with one of the plurality of address electrodes. Each of the plurality of sets includes a first plane discharge electrode and a second plane discharge electrode. The first plane discharge electrode is provided above a corresponding one of the plurality of row separation walls and a corresponding one of the rows of the plurality of discharge cells, and the second plane discharge electrode is provided above the corresponding one of the rows of the plurality of discharge cells.

Here, the plasma display apparatus may further include a control unit which controls the drive unit.

Also, each of the first plane discharge electrode and the second plane discharge electrode may include a transparent electrode and a bus electrode connected with the transparent electrode, the bus electrode having a lower resistivity than the transparent electrode. The transparent electrode of the first plane discharge electrode is the corresponding one of the plurality of row separation walls and the corresponding one of the rows of the plurality of discharge cells. The bus electrode of the first plane discharge electrode is provided straightly above the corresponding one of the rows of the plurality of discharge cells. The second plane discharge electrode is provided straightly above the corresponding one of the rows of the plurality of discharge cells.

Also, the first plane discharge electrode may be a sustain electrode and the second plane discharge electrode is a scan electrode. Also, the first plane discharge electrode may be a scan electrode and the second plane discharge electrode may be a sustain electrode. Also, in an odd-numbered one of the plurality of sets, the first plane discharge electrode may be a sustain electrode and the second plane discharge electrode may be a scan electrode, and in an even-numbered one of the plurality of sets, the first plane discharge electrode may be the scan electrode and the second plane discharge electrode may be the sustain electrode. In addition, in an odd-numbered one of the plurality of sets, the first plane discharge electrode may be a scan electrode and the second plane discharge electrode may be a sustain electrode, and in an even-numbered one of the plurality of sets, the first plane discharge electrode may be the sustain electrode and the second plane discharge electrode may be the scan electrode.

Also, the transparent electrode of the first plane discharge electrode may include a first portion provided straightly above the corresponding row of the plurality of discharge cells; and a second portion provided for each of the plurality of discharge cells of the corresponding one row to connect the bus electrode of the first plane discharge electrode and the first portion.

BRIEF DESCRIPTION OF THE DRAWINGS

FIGS. 26A to 26C are timing charts showing drive voltage waveforms to drive the plasma display panel of the conventional plasma display apparatus;

FIGS. 27A to 27C are expanded views of A section in Figs. FIGS. 26A to 26C;

DESCRIPTION OF THE PREFERRED EMBODIMENTS

Hereinafter, a plasma display apparatus according to the present invention will be described below with reference to the attached drawings.

First Embodiment

Figure 1:
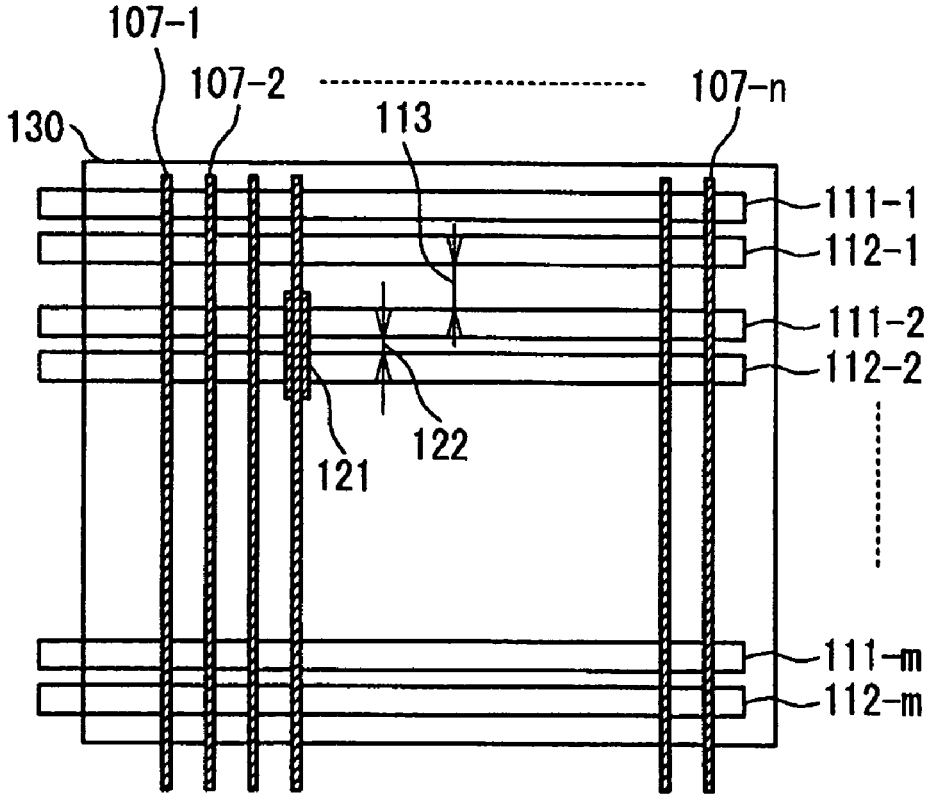
Fig. 1 PRIOR ART
FIG. 1 shows a structure of a conventional plasma display apparatus.
Figure 2:
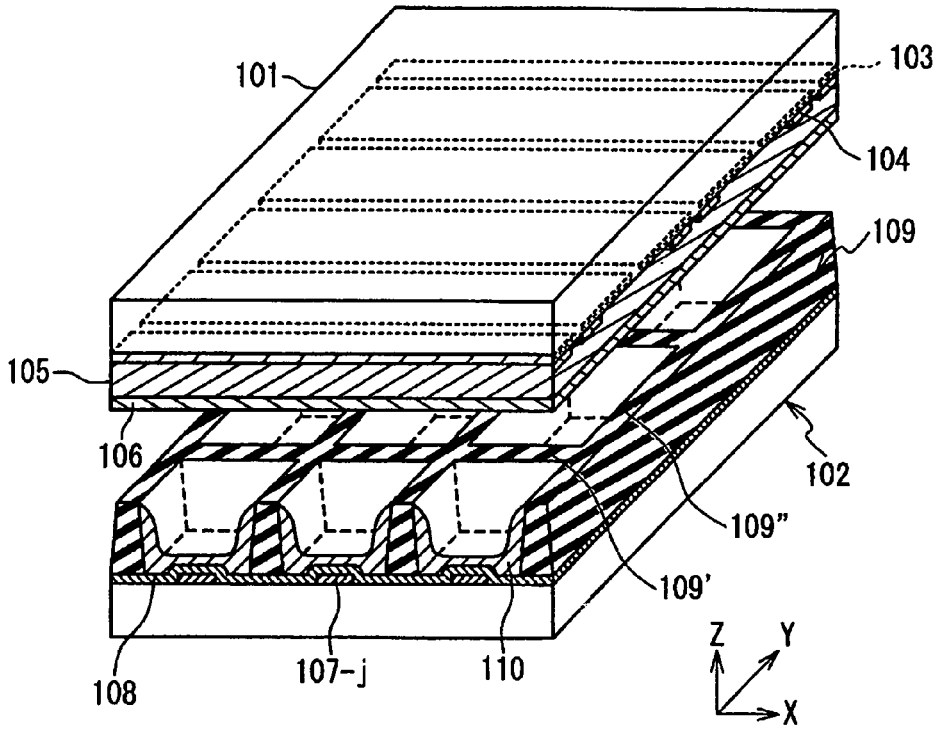
Fig. 2 PRIOR ART
FIG. 2 is a perspective sectional view showing a part of the conventional plasma display panel.
Figure 3:
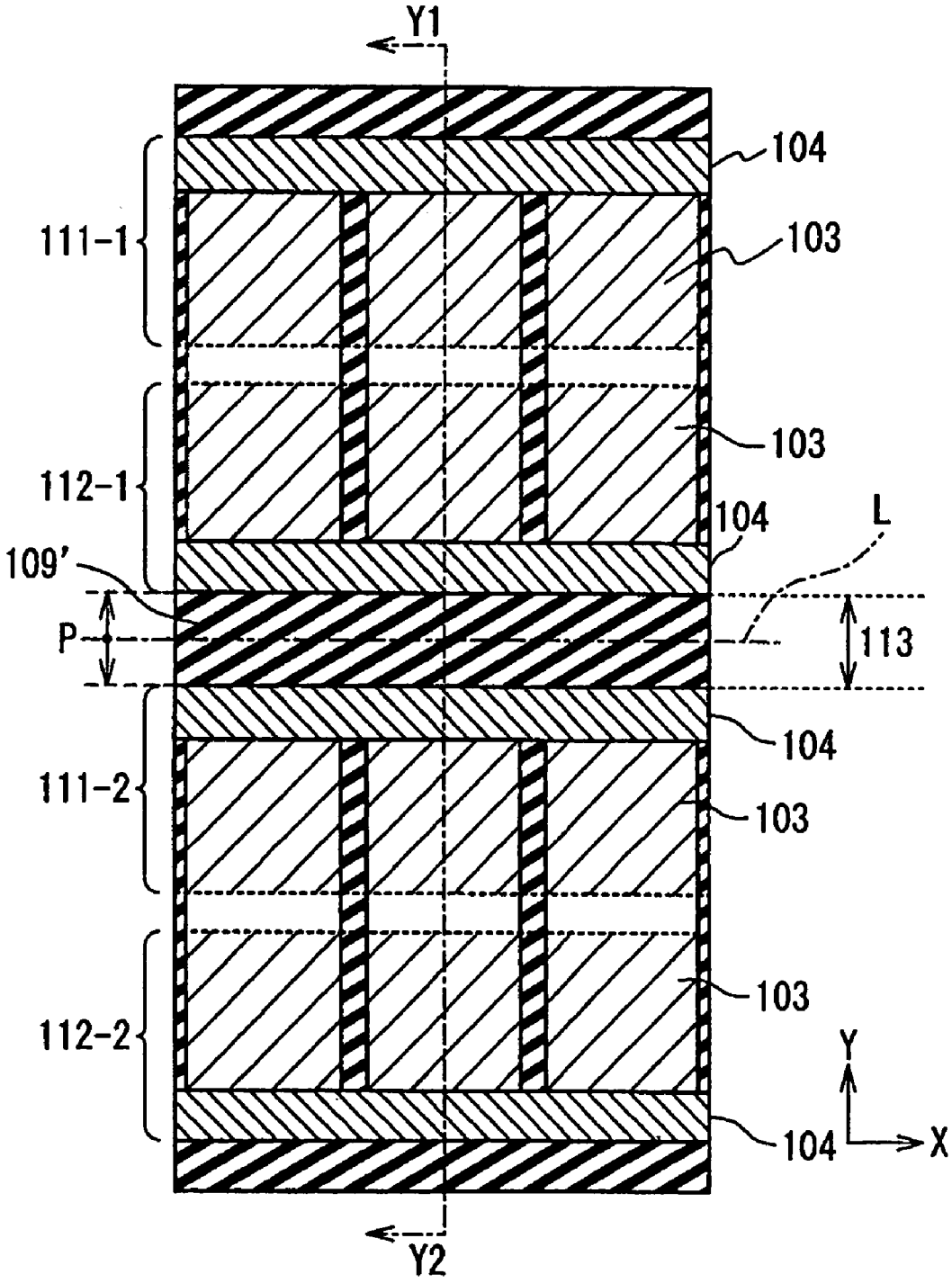
Fig. 3 PRIOR ART
FIG. 3 is a plan view showing a part of the conventional plasma display panel.
Figure 4:
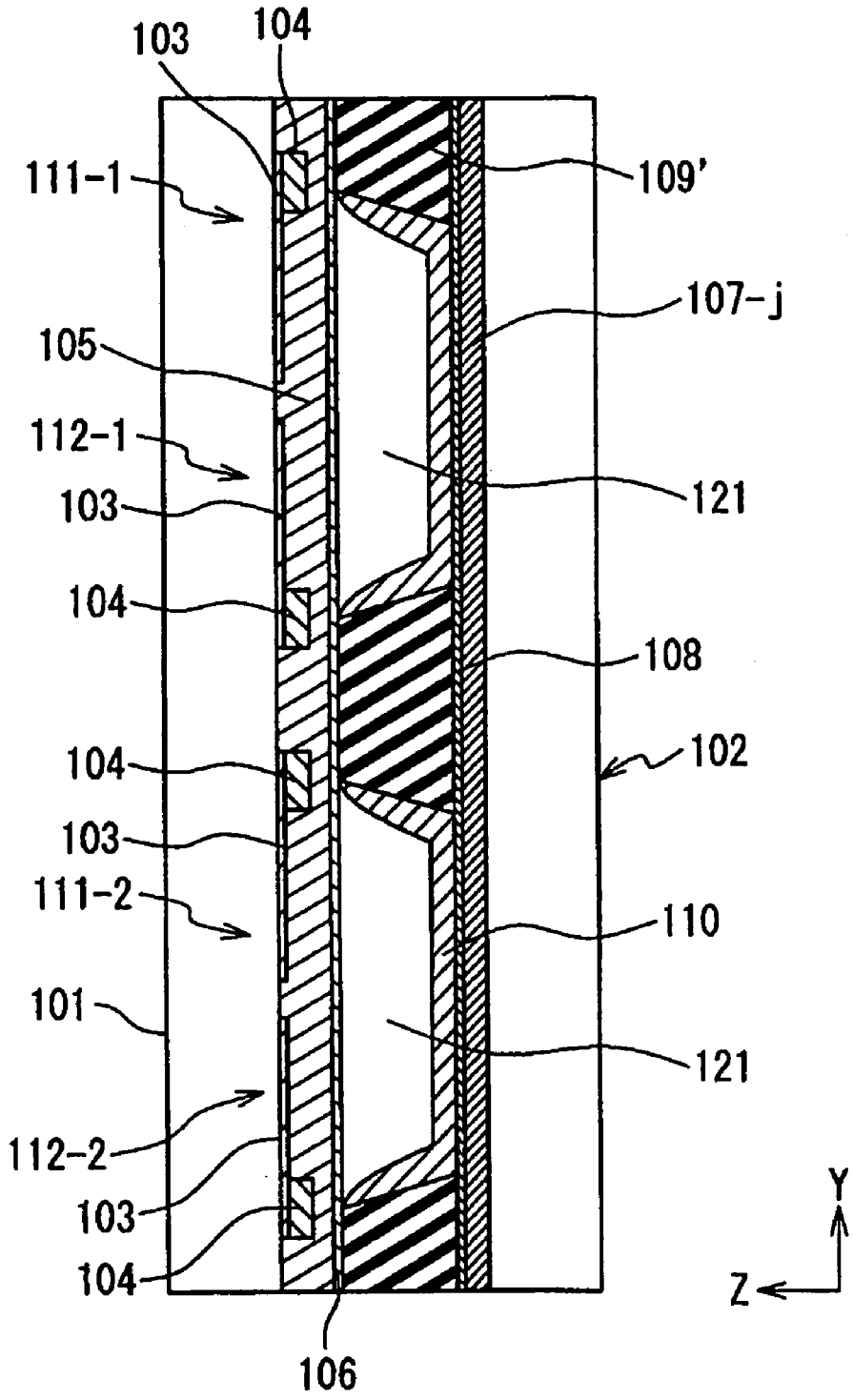
Fig. 4 PRIOR ART
FIG. 4 is a cross sectional view showing the conventional plasma display panel along the Y1-Y2 line in FIG. 3.
Figures 5A, 5B, 5C, 5D, 5E, 5F, 5G, 5H:
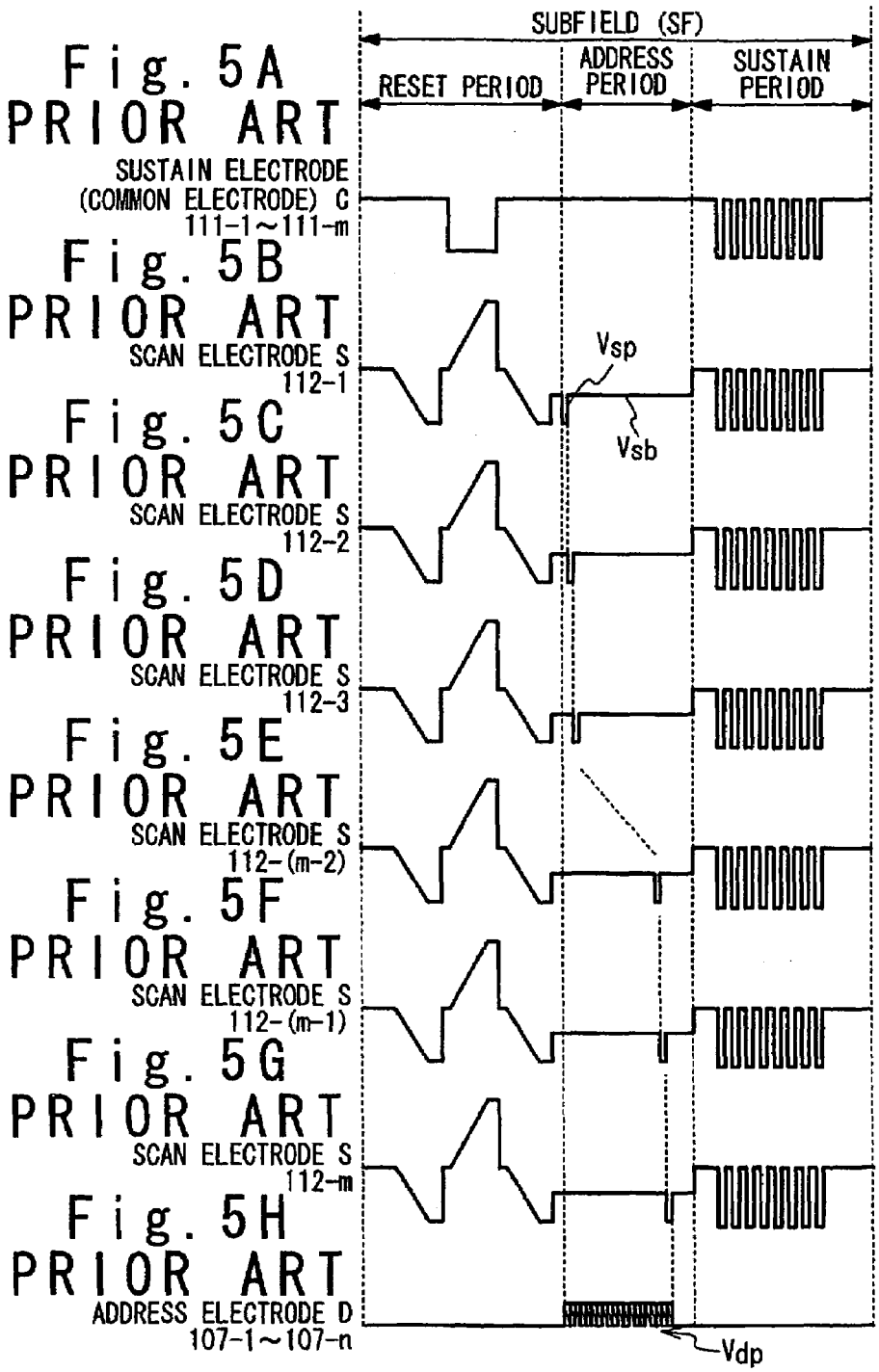
Fig. 5A PRIOR ART
Fig. 5B PRIOR ART
Fig. 5C PRIOR ART
Fig. 5D PRIOR ART
Fig. 5E PRIOR ART
Fig. 5F PRIOR ART
Fig. 5G PRIOR ART
Fig. 5H PRIOR ART
FIGS. 5A to 5H are timing charts showing drive voltage waveforms to drive the conventional plasma display panel.
Figure 6:
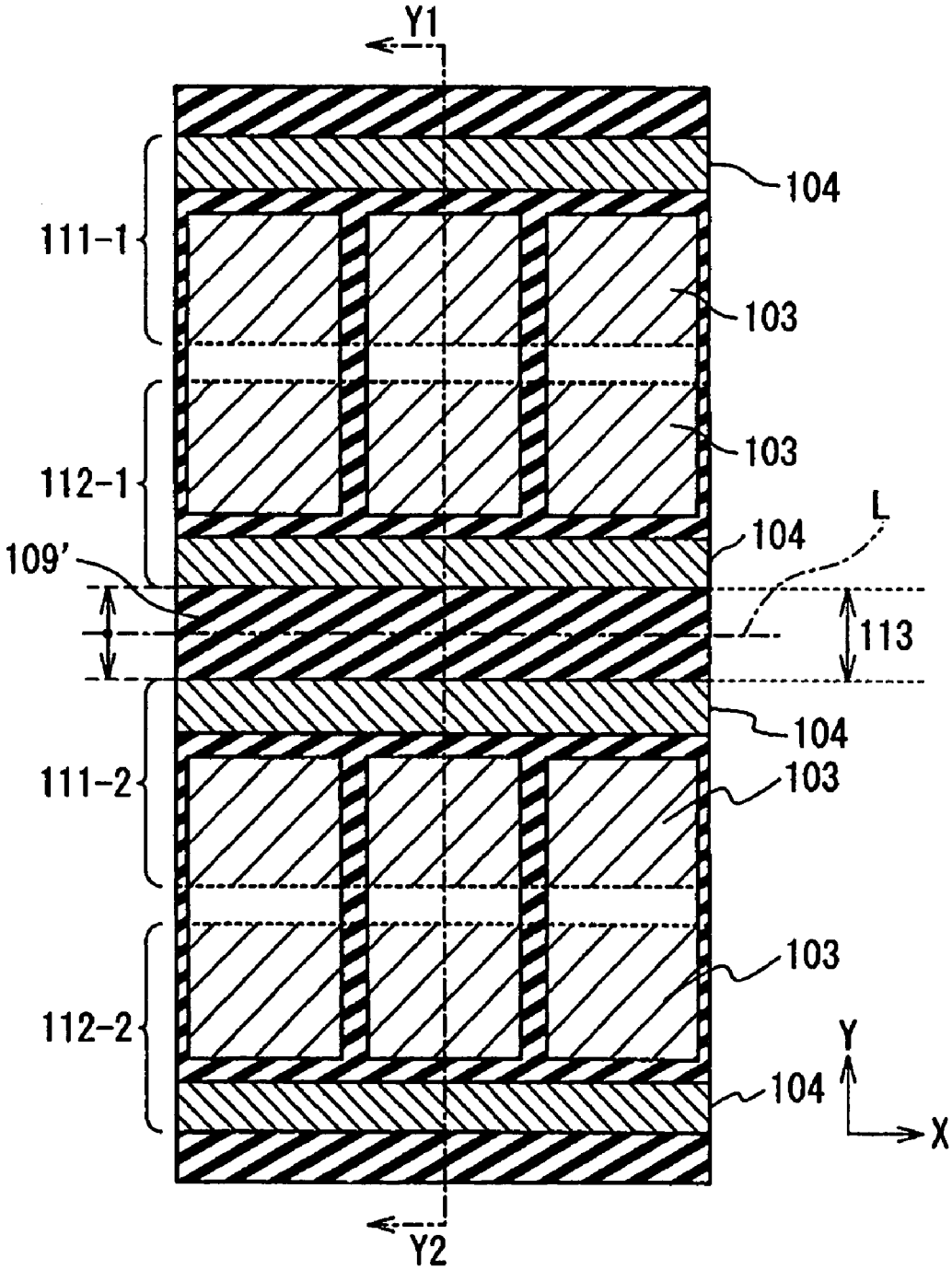
Fig. 6 PRIOR ART
FIG. 6 is a plan view showing a part of another conventional plasma display panel in a case of (A)
Figure 7:
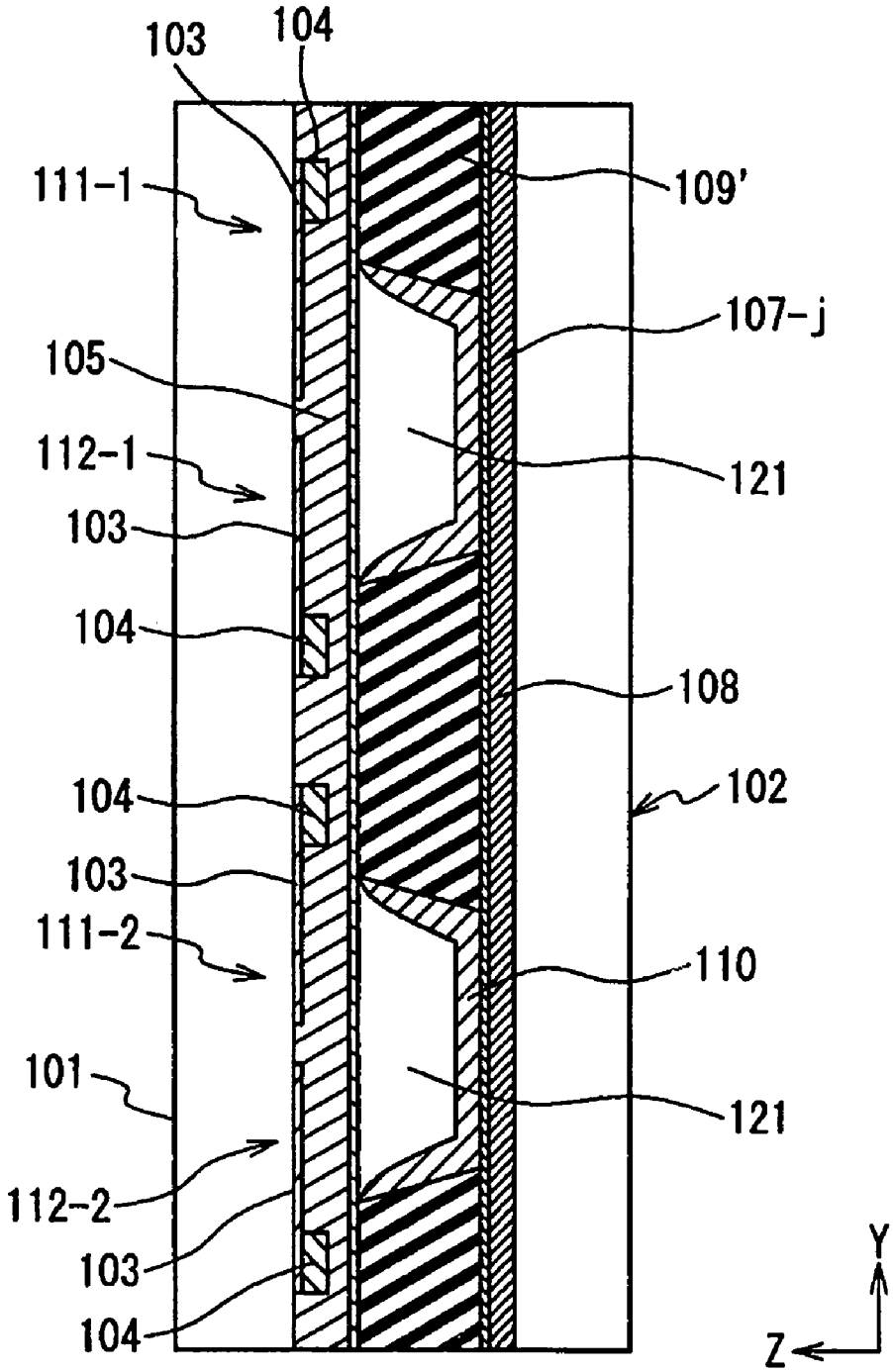
Fig. 7 PRIOR ART
FIG. 7 is a cross sectional view showing the other conventional plasma display panel along the Y1-Y2 line in FIG. 6.
Figure 8:
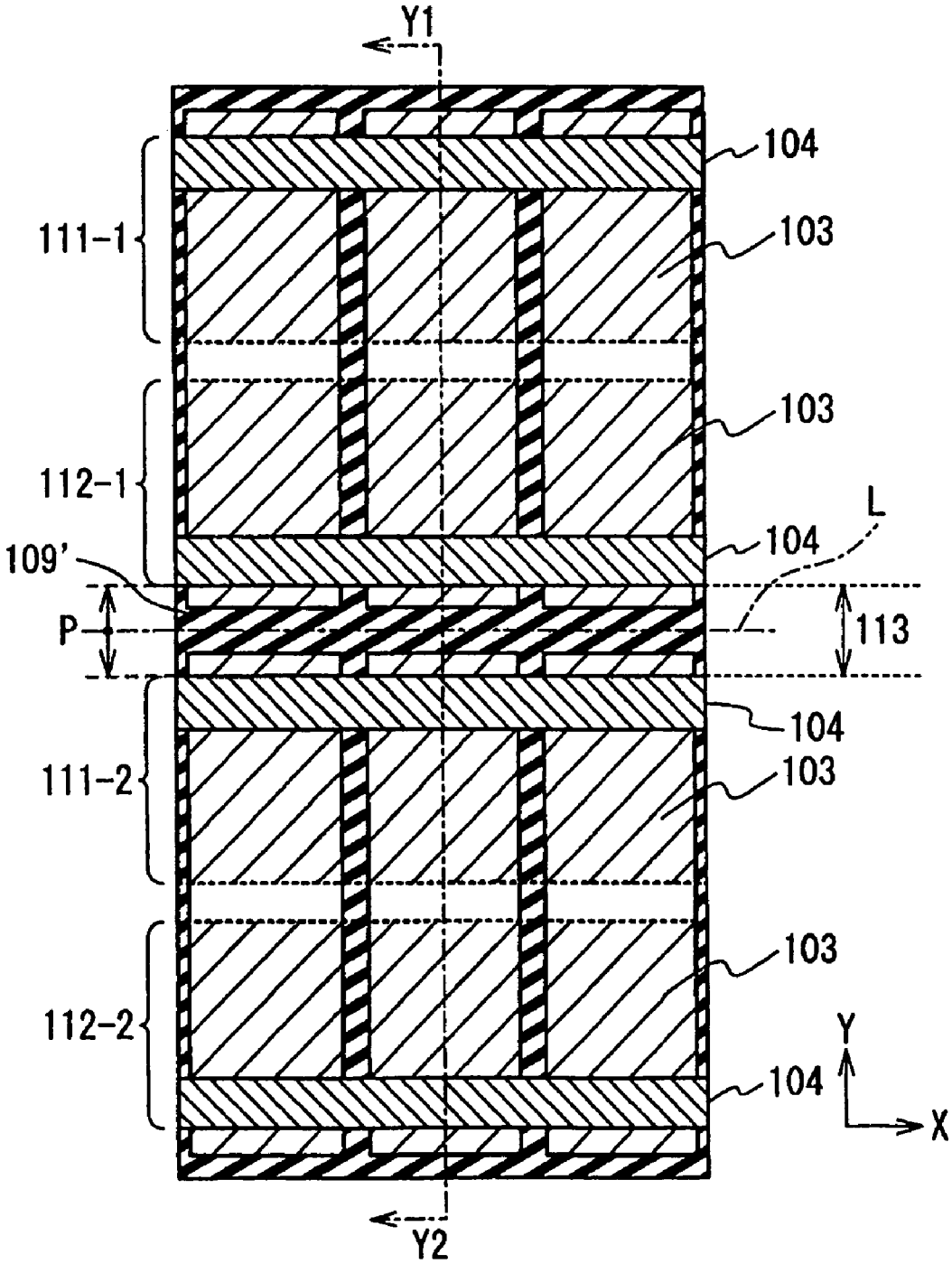
Fig. 8 PRIOR ART
FIG. 8 is a plan view showing a part of still another conventional plasma display panel in a case of (B)
Figure 9:
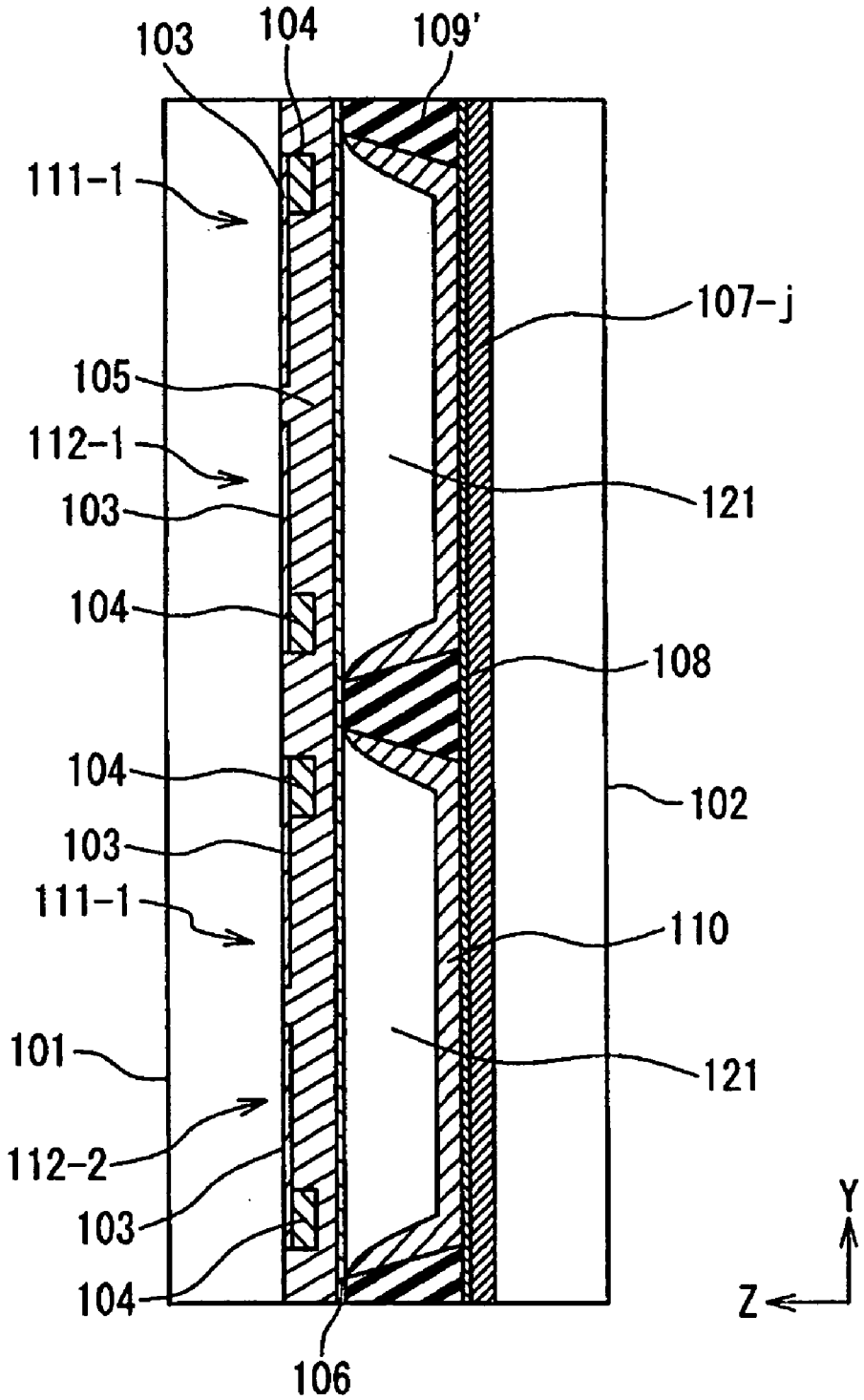
Fig. 9 PRIOR ART
FIG. 9 is a cross sectional view showing the other conventional plasma display panel along the Y1-Y2 line in FIG. 6.
Figure 10:
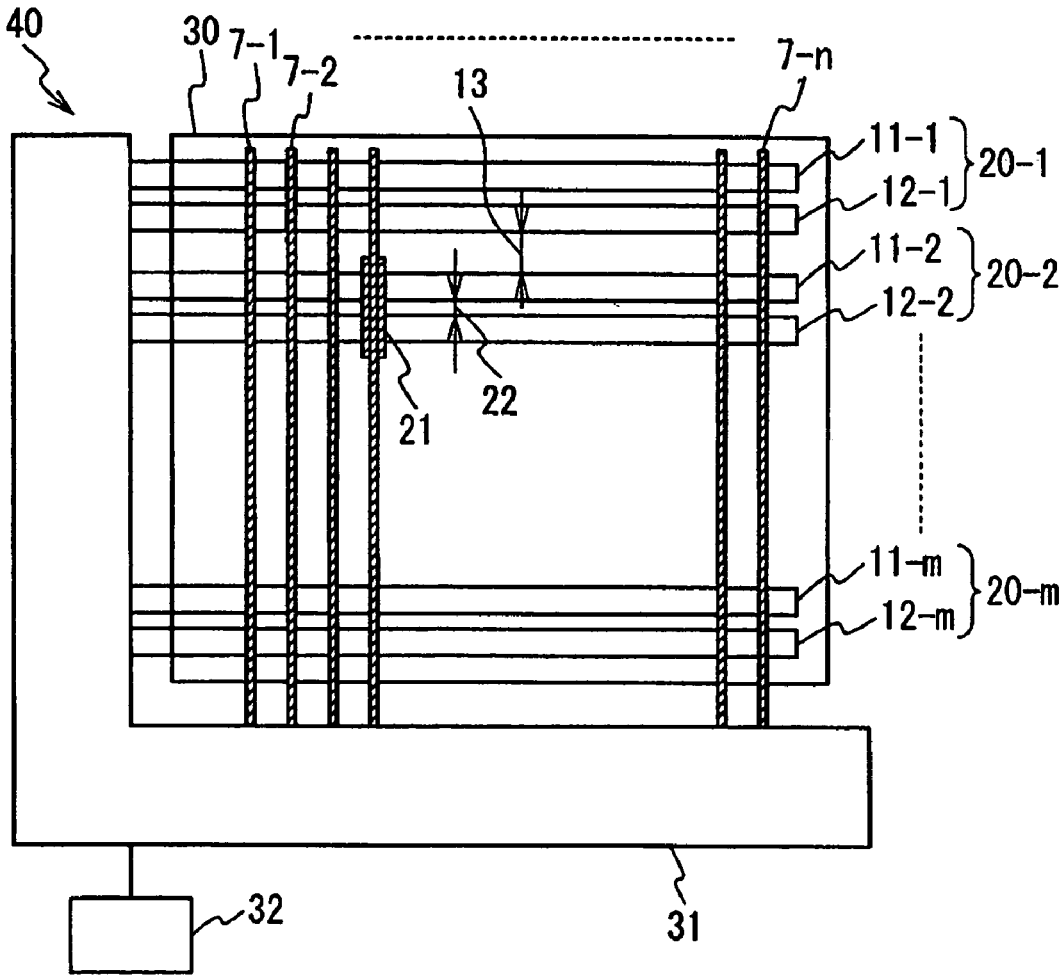
FIG. 10 shows a structure of a plasma display apparatus according to a first embodiment of the present invention.

FIG. 10 shows the structure of a plasma display apparatus 40 to which the plasma display panel 30 according to the first embodiment of the present invention is applied. The plasma display apparatus 40 includes the plasma display panel 30 that is a 3-electrode AC type plasma display panel (PDP), a driver section 31 and a control section 32. The driver section 31 is connected to the plasma display panel 30. The control section 32 is connected to the driver section 31 to drive the driver section 31. The driver section 31 includes a scan driver (not shown) for driving scan electrodes, and address drivers (data driver) (not shown) for driving address electrodes (data electrode).

The plasma display panel 30 includes surface discharge electrode sets 20-1 to **20-*m* (m is an even integer of 2 or more), address electrodes (D) 7-1 to 7-*n* (n is an even integer of 2 or more), and (m×n) cells 21 in which discharge gas is enclosed. The (m×n) cells 21 (pixels) are arranged in a matrix of m rows and n columns. The surface discharge electrode set 20-*i* (i=1, 2 to m) is provided in common to the n cells 21 of the i-th row. The address electrode (D) 7-*j* (j=1, 2 to n) orthogonal to the surface discharge electrode set 20-*i* is provided in common of the m cells 21** of the j-th column.

Each of the surface discharge electrode sets 20-1 to **20-*m* has two discharge electrodes, i.e., a sustain electrode and a scan electrode. Thus, the plasma display panel 30 has the sustain electrodes (C) 11-1 to 11-*m* and the scan electrodes (S) 12-1 to 12-*m*. Since the sustain electrode (C) and the scan electrode (S) are alternately arranged, such structure is referred to as a CS electrode structure. A discharge gap 22 is formed between the sustain electrode (C) 11-*i* and the scan electrode (S) 12-*i*, and a non-discharge gap 13 is formed between the sustain electrode (C) 11-*i*+1 and the scan electrode (S) 12-*i***.

Figure 11:
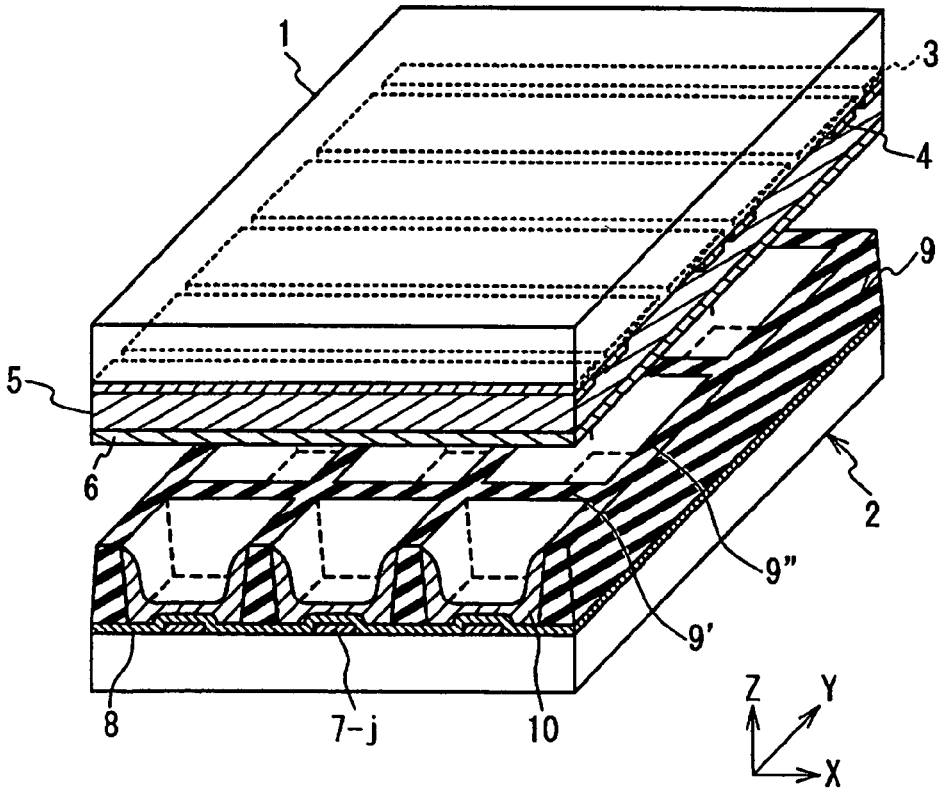
FIG. 11 is a perspective sectional view showing a part of a plasma display panel of the plasma display apparatus according to the first embodiment of the present invention.

FIG. 11 is a perspective sectional view showing a part of the plasma display panel 30 according to the first embodiment of the present invention. The plasma display panel 30 is further composed of a front substrate section on the display side and a back substrate section. The front substrate section is composed of a front substrate 1, a transparent dielectric layer S, and a protection layer 6, in addition to the surface discharge electrode sets 20-1 to **20-*m*. The back substrate section is composed of a back substrate 2, a dielectric layer 8, separation walls 9 and a phosphor layer 10, in addition to the address electrodes (D) 7-1 to 7-*n*. A glass substrate is exemplified as the front substrate 1 and the back substrate 2. The address electrode (D) 7-*j* is provided above the back substrate 2 to extend in the column direction. The dielectric layer 8 is provided above the back substrate 2 and the address electrode (D) 7-*j***.

The separation walls 9 are provided between the front substrate 1 and the dielectric layer 8. The (m×n) cells 21 are portioned by the separation walls 9, and are arranged in a matrix of the m rows and n columns. The separation walls 9 have horizontal separation walls 9' and vertical separation walls 9" in order to protect the crosstalk of discharge. The horizontal separation walls 9' are provided to extend to the row direction (row direction) orthogonal to the address electrodes (D) **7-*j*. The vertical separation walls 9" are provided to extend to the column direction (vertical direction) parallel to the address electrodes (D) 7-*j***.

Also, the horizontal separation wall 9' has the effects of preventing the following faults. That is, the horizontal separation wall 9' prevents light emission from a cell 21 on which a write operation is not carried out, namely, erroneous light emission. Also, the horizontal separation wall 9' prevents the occurrence of a write fault, in case that when the write operation is carried out on the first and second cells 21 adjacent in the column direction, the orientation of the electric field by a wall charge accumulated in the first cell 21 in which discharge is first carried out is opposite to the orientation of the electric field by an application voltage so that the electric field in the second cell 21 in which discharge is carried out later is weakened.

The phosphor layer 10 of red, green, and blue is formed on the dielectric layer 8 and the side surfaces of the separation wall 9 by a screen print method for visible light emission. The protection layer 6 is provided above the separation wall 9 between the front substrate 1 and the separation wall 9. The transparent dielectric layer 5 is provided between the front substrate 1 and the protection layer 6.

Figure 12:
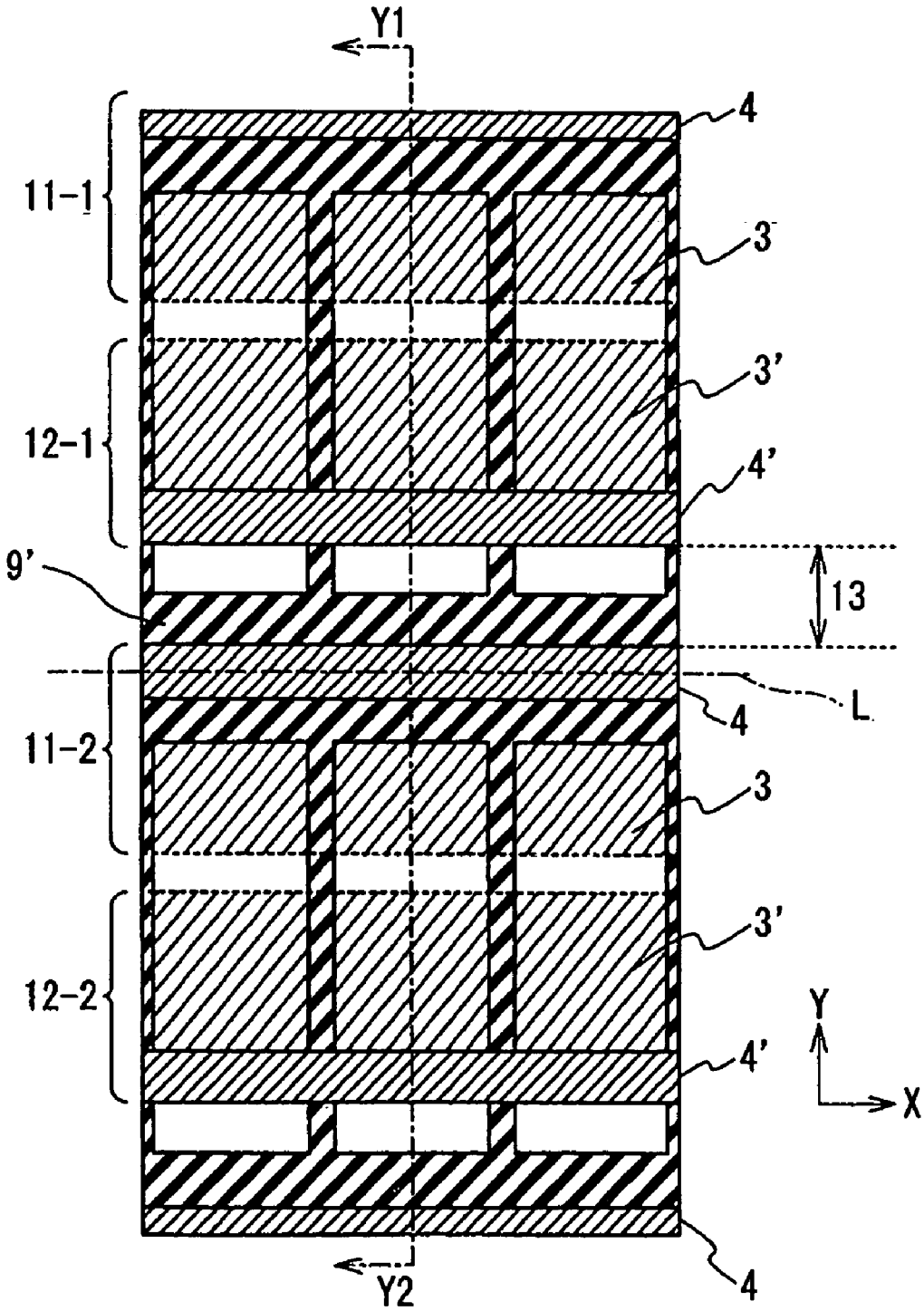
FIG. 12 is a plan view showing a part of the plasma display panel of the plasma display apparatus according to the first embodiment of the present invention.
Figure 13:
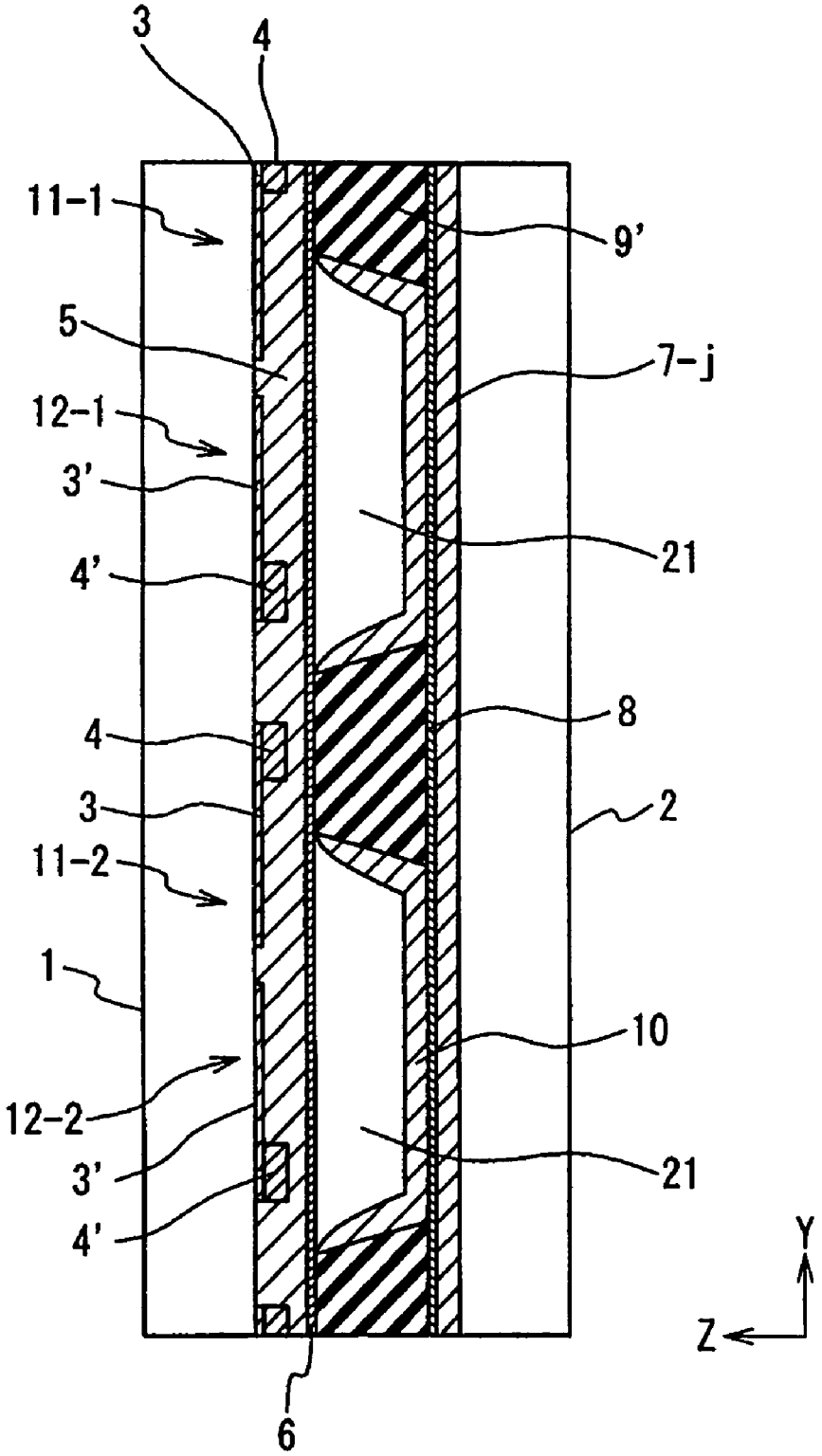
FIG. 13 is a cross sectional view showing the plasma display panel along the Y1-Y2 line in FIG. 12.

FIG. 12 is a plan view showing a part of the plasma display panel 30 according to the first embodiment of the present invention. FIG. 13 is a sectional view of the plasma display panel 30 along the Y1-Y2 line in FIG. 12.

The above-mentioned surface discharge electrode sets 20-1 to **20-*m* are provided to extend in the row direction between the front substrate 1 and the transparent dielectric layer 5. The surface discharge electrode sets 20-1 to 20-*m* contains the sustain electrodes (C) 11-1 to 11-*m* and the scan electrode (S) 12-1 to 12-*m*. The sustain electrode 11-*i* is composed of a transparent electrodes 3 extending to the row direction and the bus electrodes 4 extending to the row direction, and the scan electrode 12-*i* is composed of a transparent electrodes 3' extending to the row direction and the bus electrodes 4' extending to the row direction. The bus electrode 4 or 4' is provided in an end portion of the transparent electrode 3 or 3'. The transparent electrode 3 or 3' has a larger area and a high transmission factor, since a certain area is required to induce discharge of a predetermined magnitude. The bus electrode 4 or 4' is a metal electrode to decrease the line resistance of the transparent electrode 3 or 3'**.

The transparent electrodes 3 of the sustain electrodes (C) 11-1 to **11-*m* are provided above the cells 21 and the horizontal separation walls 9', and the transparent electrodes 3' of the scan electrodes (S) 12-1 to 12-*m* are provided above the cells 21. Hereinafter, the transparent electrode 3 is referred to as a first transparent electrode 3, and the transparent electrode 3' is referred to as a second transparent electrode 3'. The bus electrodes 4 of the sustain electrodes (C) 11-1 to 11-*m* are provided above the horizontal separation walls 9', and the bus electrodes 4' of the scan electrodes (S) 12-1 to 12-*m* are provided above the cells 21. Hereinafter, the bus electrode 4 is referred to as a first bus electrode 4, and the bus electrode 4 is referred to as a second bus electrode 4'**.

In a specific example shown in FIG. 12, a first gap is provided between the first transparent electrode 3 of the sustain electrode (C) 11-1 and the second transparent electrode 3' of the scan electrode (S) 12-1 to have a first predetermined distance on the cell 21. Also, the first gap is provided between the first transparent electrode 3 of the sustain electrode (C) 11-2 and the second transparent electrode 3' of the scan electrode (S) 12-2 to have the first predetermined distance above the cell 21. The first predetermined distance is the distance corresponding to the discharge gap 22. A second gap is formed between the first bus electrode 4 of the sustain electrode (C) 11-2 and the second bus electrode 4' of the scan electrode (S) 12-1 to have a second predetermined distance above the cell 21 and the horizontal separation wall 9'. The second predetermined distance is the distance corresponding to the non-discharge gap 13.

A part of the first transparent electrode 3 of the sustain electrode (C) 11-1 is formed on the horizontal separation wall 9', and the first bus electrode 4 is provided above the horizontal separation wall 9' such that the first bus electrode 4 is connected with the part of the first transparent electrode 3. Also, the second transparent electrode 3' of the scan electrode (S) 12-1 is provided above the cell 21 and the second bus electrode 4' of the scan electrode (S) 12-1 is provided above the cell 21 to be connected with the end of the second transparent electrode 3' on the side of the sustain electrode (C) 11-2.

As described above, the first bus electrodes 4 of the sustain electrodes (C) 11-1 to **11-*m* are provided above the horizontal separation walls 9' so as for each first bus electrode 4 to overlap a center line L of the horizontal separation wall 9'. The center line L extends to the row direction. The center line L is used as a reference line in order to provided the sustain electrodes (C) 11-1 to 11-*m* and the scan electrodes (S) 12-1 to 12-*m***.

According to the above-mentioned structure, in the plasma display panel 30 according to the first embodiment of the present invention, it is hard to receive the influence of the variation in the manufacture, and the high aperture percentage can be achieved. Also, in the plasma display panel 30 according to the first embodiment of the present invention, the stable write characteristic operation can be obtained.

When the first substrate section containing the sustain electrodes (C) 11-1 to **11-*m* and the scan electrodes (S) 12-1 to 12-*m* is arranged in the manufacture, a central point P between the bus electrodes and the center line L of the horizontal separation wall 9' are mated with each other in the conventional plasma display panel 130. However, in the plasma display panel 30 according to the first embodiment of the present invention, the first bus electrodes 4 of the sustain electrodes (C) 11-1 to 11-*m* are arranged above of the center line L of the horizontal separation walls 9'**. Thus, it is hard to receive the influence of the variation in the manufacture.

Figures 14A, 14B, 14C, 14D, 14E, 14F, 14G, 14H:
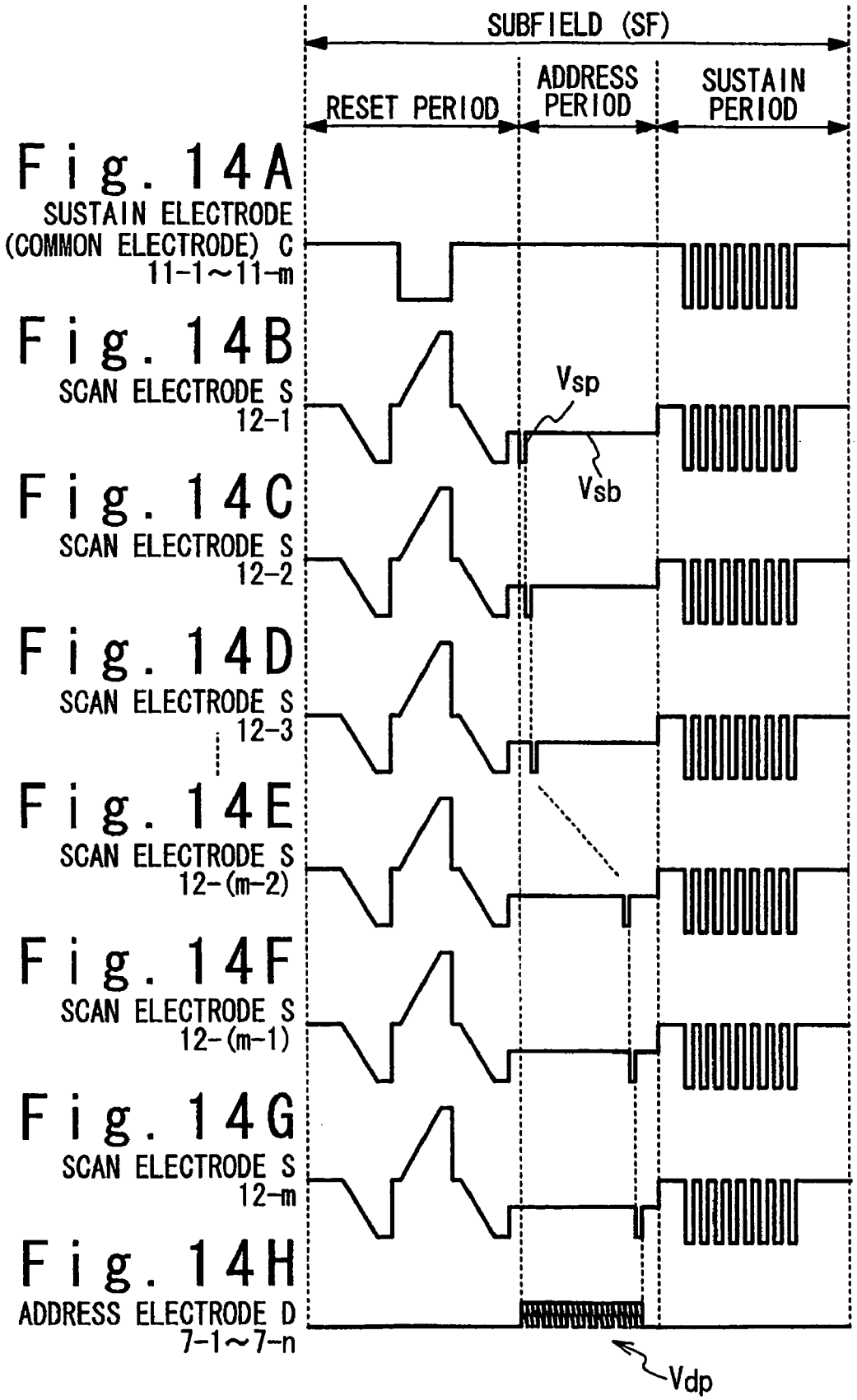
FIGS. 14A to 14H are timing charts showing drive voltage waveforms to drive the plasma display panel of the plasma display apparatus according to the first embodiment of the present invention.

An aperture percentage is determined based on a summation of the non-discharge gap 13 and the width of one second bus electrode 4' in the column direction. Thus, the plasma display panel 30 according to the first embodiment of the present invention can achieve the high aperture percentage similar to the case (C) in the conventional plasma display panel 130. Therefore, the sufficient light emission brightness can be achieved Next, the stable write characteristic operation will be described below. FIG. 14 is timing charts showing drive voltage waveforms when the plasma display panel 30 according to the first embodiment of the present invention is driven. A scan and sustain separating method (ADS method) is applied to the plasma display panel 30. In the ADS method, one field (or one subfield) is divided into a reset period, an address period and a sustain period.

The reset period is a period in which the wall charges accumulated between the scan electrode (S) **12-*i* and the sustain electrode (C) 11-*i*** during the sustain discharge in the sustain period are removed (initialized, reset).

The address period is a period in which the write characteristic operation is carried out. The write characteristic operation implies that the write discharge is carried out between the scan electrode (S) **12-*i* and the sustain electrode (C) 11-*i*, to write a picture data indicative of a picture into the address (cell 21**).

The sustain period is a period in which the sustain discharge is carried out between the sustain electrode (C) **11-*i* and the scan electrode (S) 12-*i* such that the write discharge is carried out in the cell 21** based on the picture data.

The control section 32 drives the driver section 31 so that a voltage to be described later is applied between the electrodes of the plasma display apparatus.

In the reset period, the driver section 31 initially keeps the sustain electrodes (C) 11-1 to **11-*m* and the scan electrodes (S) 12-1 to 12-*m* to sustain voltages, and keeps the address electrodes (D) 7-1 to 7-*n* to the ground voltage. At this time, the wall charges accumulated between the scan electrode (S) 12-*i* and the sustain electrode (C) 11-*i* during the sustain discharge in the sustain period are removed (initialized, reset). Then, the driver section 31 gradually decreases the voltage applied to the scan electrodes (S) 12-1 to 12-*m* from the sustain voltage toward the ground potential, and keeps the scan electrodes (S) 12-1 to 12-*m* to the ground voltage. Subsequently, the driver section 31 applies the ground voltage to the sustain electrodes (C) 11-1 to 11-*m*, and applies the sustain voltage to the scan electrodes (S) 12-1 to 12-*m***.

Next, the generation of a priming effect is carried out. The driver section 31 gradually increases the voltage applied to the scan electrodes (S) 12-1 to **12-*m* from the sustain voltage to a priming voltage, and keeps the scan electrodes (S) 12-1 to 12-*m* to the priming potential. The priming potential is higher than the sustain voltage. Thus, the wall charges accumulated on the dielectric layer in the cell 21 is removed by the priming effect. The driver section 31 applies the sustain voltage to the sustain electrodes (C) 11-1 to 11-*m*, and keeps the sustain electrodes (C) 11-1 to 11-*m* to the sustain voltage. The driver section 31 decreases the voltage applied to the scan electrodes (S) 12-1 to 12-*m* from the priming potential to the sustain voltage. After that, the driver section 31 gradually decreases the voltage applied to the scan electrodes (S) 12-1 to 12-*m* from the sustain voltage to the ground voltage, and keeps the scan electrodes (S) 12-1 to 12-*m*** to the ground potential.

In the address period, the driver section 31 keeps the sustain electrodes (C) 11-1 to **11-*m* to the sustain voltage. The driver section 31 applies a scan base voltage Vsb to the scan electrodes (S) 12-1 to 12-*m*, and keeps the scan electrodes (S) 12-1 to 12-*m* to the scan base potential Vsb. The scan base potential Vsb is such a voltage that its minimum value is defined as the ground voltage, which is the reference voltage, and its maximum value is defined as a set voltage which is lower than the sustain voltage. Subsequently, while the scan base voltage Vsb (set voltage) is applied to the scan electrodes (S) 12-1 to 12-*m*, the driver section 31 sequentially applies a scan pulse voltage Vsp to the scan electrodes (S) 12-1 to 12-*m*, to cancel the scan base voltage Vsb (set voltage). The scan pulse voltage Vsp is a negative pulse changing from the set voltage as the maximum value of the scan base voltage Vsb to the ground voltage as the minimum value of the scan base voltage Vsb. When the scan pulse voltage Vsp (negative pulse) is applied to the scan electrodes (S) 12-1 to 12-*m*, the driver section 31 applies a data pulse voltage Vdp (write pulse) to the address electrodes (D) 7-1 to 7-*n*** based on a picture data.

In the sustain period, the driver section 31 applies the ground voltage to the scan electrodes (S) 12-1 to **12-*m* as a primary sustain pulse voltage and applies the sustain voltage to the sustain electrodes (C) 11-1 to 11-*m* as the primary sustain pulse voltage. Then, the driver section 31 alternately applies the sustain voltage and the ground voltage to the scan electrodes (S) 12-1 to 12-*m* as the sustain pulse voltage, and alternately applies the ground voltage and the sustain voltage to the sustain electrodes (C) 11-1 to 11-*m*. Also, the driver section 31 applies the ground voltage to the address electrodes (D) 7-1 to 7-*n***.

When the ADS method is used to carry out a gradation display, one field is divided into a plurality of subfields and a weight is allocated by changing the number of sustain pulses in each subfield.

From the above-mentioned description, in the plasma display panel 30 according to the first embodiment of the present invention, it is possible to achieve the stable write characteristic operation, in addition to the above-mentioned effects that it is hard to receive the influence of the variation in the manufacture, and the high aperture percentage can be achieved.

Although the first bus electrodes 4 of the sustain electrodes (C) 11-1 to **11-*m* are provided above the horizontal separation wall 9', the second bus electrodes 4' of the scan electrodes (S) 12-1 to 12-*m* are provided above the discharge spaces or the cells 21. Thus, in the address period, the write discharge is stably caused. After that, in the sustain period, it stably proceeds to the sustain discharge. It is supposed that the distance between the bus electrodes is 80 μm, the width of the column direction of the bus electrode (the first bus electrode 4, the second bus electrode 4') is 30 μm and the width of the horizontal separation wall 9' in the column direction is 140 μm. At this time, since the first bus electrode 4 is arranged above the vicinity of the center line L of the horizontal separation wall 9', there is no case that the sustain electrodes (C) 11-1 to 11-*m* are fully arranged above the discharge spaces or the cells 21, even if an arrangement shift of about several ten μm in the manufacture has occurred. Therefore, there is no case that the sustain electrodes (C) 11-1 to 11-*m*** shield light emitted through the discharge.

The second bus electrodes 4' of the scan electrodes (S) 12-1 to **12-*m* are fully arranged above the discharge spaces or the cells 21. Thus, there is no case that the second bus electrodes 4' are not arranged above the horizontal separation walls 9'** even in case of the occurrence of the arrangement shift of about several ten μm in the manufacture. Therefore, there is no case that the write discharge becomes unstable due to the arrangement-shift in the manufacture and the discharge always stably proceeds to the sustain discharge. Thus, the stable write characteristic operation can be achieved.

Second Embodiment

As mentioned above, in the first embodiment, the scan electrodes (S) 12-1 to **12-*m* are provided above the discharge spaces or the cells 21 through adoption of the CS electrode structure. In the plasma display panel 30 according to the second embodiment of the present invention, the SC electrode structure is adopted in which the sustain electrodes (C) 11-1 to 11-*m* are provided above the discharge spaces or the cells 21**. In this case, by changing the above-mentioned drive voltage waveforms, the second embodiment can achieve the effect similar to that of the first embodiment.

Figure 15:
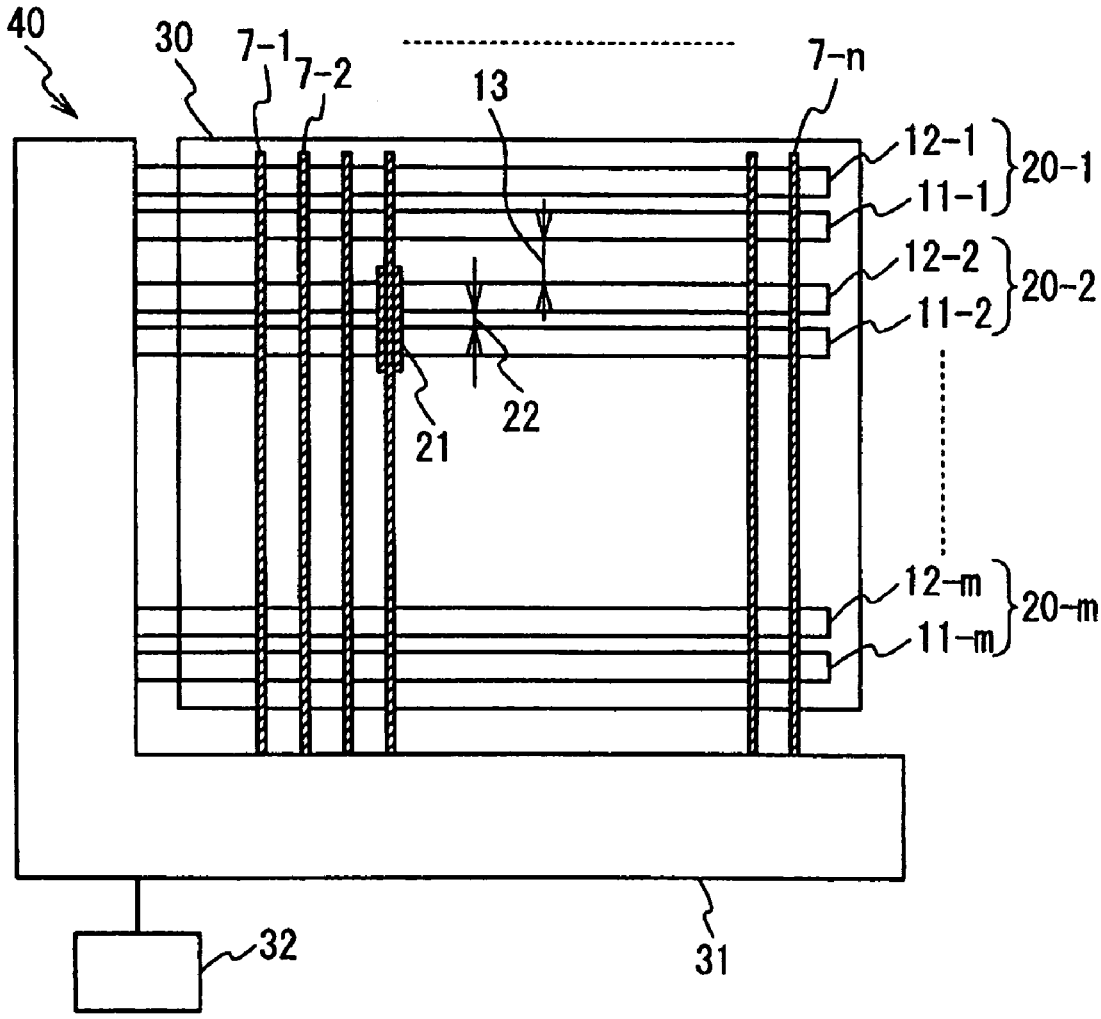
FIG. 15 shows a structure of a plasma display apparatus according to a second embodiment of the present invention.

The plasma display panel 30 according to the second embodiment of the present invention will be described below. However, the description of the same components as those of the first embodiment is omitted. FIG. 15 shows the structure of the display apparatus 40 to which the plasma display panel 30 according to the second embodiment of the present invention is applied. In case of the SC electrode structure, the surface discharge electrode sets 20-1 to **20-*m* are composed of the scan electrodes (S) 12-1 to 12-*m* and the sustain electrodes (C) 11-1 to 11-*m***.

Figure 16:
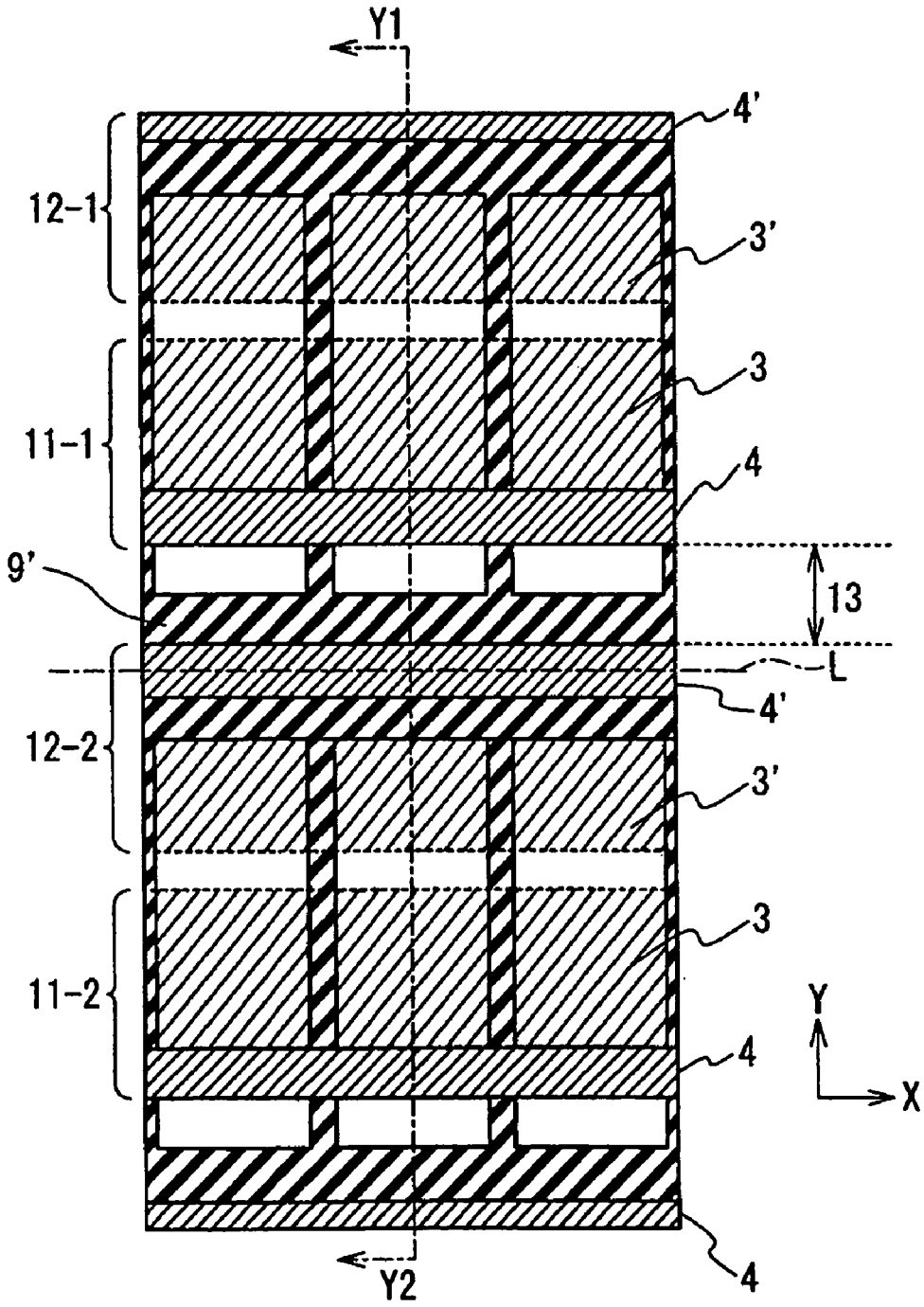
FIG. 16 is a plan view showing a part of the plasma display panel of the plasma display apparatus according to the second embodiment of the present invention.
Figure 17:
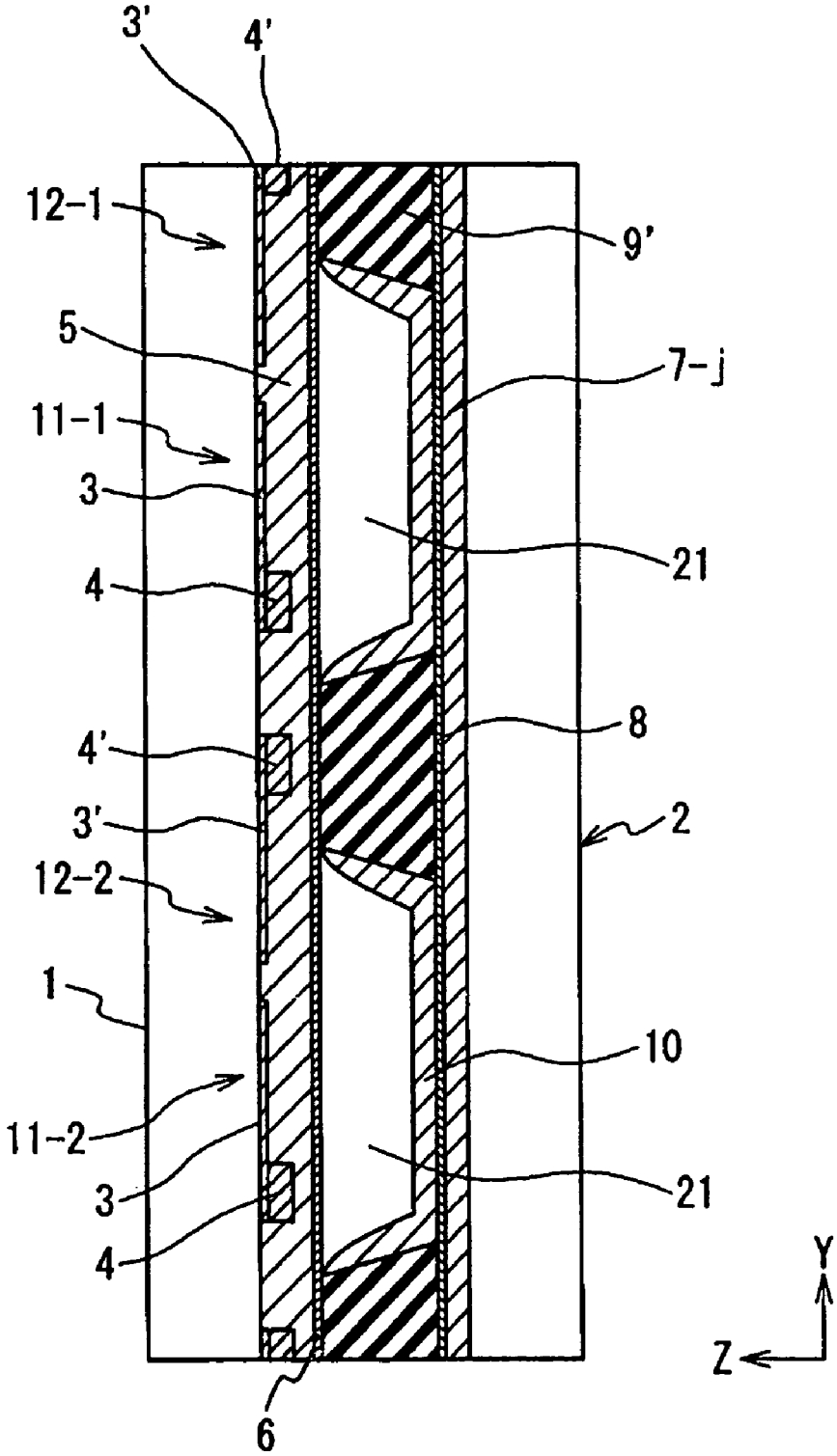
FIG. 17 is a cross sectional view showing the plasma display panel along the Y1-Y2 line in FIG. 16.

FIG. 16 is a plan view showing a part of the plasma display panel 30 according to the second embodiment of the present invention. FIG. 17 is a cross sectional view of the plasma display panel 30 along the Y1-Y2 line of FIG. 16. In case of the SC electrode structure, the second transparent electrodes 3' of the scan electrodes (S) 12-1 to **12-*m* are provided above the cells 21 and the horizontal separation walls 9', and the first transparent electrodes 3 of the sustain electrodes (C) 11-1 to 11-*m* are provided above the cells 21. The second bus electrodes 4' of the scan electrodes (S) 12-1 to 12-*m* are provided above the horizontal separation walls 9', and the first bus electrodes 4 of the sustain electrodes (C) 11-1 to 11-*m* are provided above the cells 21**.

In a specific example shown in FIG. 16, a first gap is provided between the second transparent electrode 3' of the scan electrode (S) 12-1 and the first transparent electrode 3 of the sustain electrode (C) 11-1 to have the first predetermined distance above the cell 21. Another first gap is provided between the second transparent electrode 3' of the scan electrode (S) 12-2 and the first transparent electrode 3 of the sustain electrode (C) 11-2 to have the first predetermined distance above the cell 21. A second gap is formed between the second transparent electrode 3' of the scan electrode (S) 12-2 and the first bus electrode 4 of the sustain electrode (C) 11-1 to have the second predetermined distance. A part of the second transparent electrode 3' of the scan electrode (S) 12-1 is formed above the horizontal separation wall 9', and the second bus electrode 4' is provided above the horizontal separation wall 9' and is connected with the part of the second transparent electrode 3'. The first transparent electrode 3 of the scan electrode (C) 11-1 is formed above the cell 21, and the first bus electrode 4 is also provided above the cell 21 and is connected with a part of the first transparent electrode 3 of the sustain electrode (C) 11-1.

As described above, in the plasma display panel 30 according to the second embodiment of the present invention, the first bus electrodes 4 of the scan electrodes (S) 12-1 to **12-*m* are provided above the horizontal separation walls 9'**. Thus, the second embodiment can achieve a stable write characteristic operation in addition to the advantages in the first embodiment.

In the second embodiment, the first bus electrodes 4 of the sustain electrodes (S) 11-1 to **11-*m* are provided above the cells 21, although the second bus electrodes 4' of the scan electrodes (S) 12-1 to 12-*m* are provided above the vicinity of the center line L of the horizontal separation wall 9'**. As a result, the write discharge can be stably carried out in the address period and then the discharge proceeds to the sustain discharge.

In the second embodiment, the distance between the bus electrodes is 80 μm, the width of the bus electrode (the first bus electrode 4 or the second bus electrode 4') in the column direction is 30 μm and the width of the horizontal separation wall 9' in the column direction is 140 μm. Therefore, even if the arrangement shift of about several ten μm in the manufacture is caused, there is no case that the scan electrodes (S) 12-1 to **12-*m* are fully provided above the discharge spaces or the cells 21**. Thus, the scan electrodes never shield the light emitted through discharge. Thus, the stable write characteristic operation can be achieved.

Also, the first bus electrodes 4 of the sustain electrodes (C) 11-1 to **11-*m* are fully arranged above the discharge spaces or the cells 21. Thus, there is no case that the first bus electrodes 4 are not arranged above the horizontal separation walls 9'** even in case of the occurrence of the arrangement shift of about several ten μm in the manufacture. Therefore, there is no case that the write discharge becomes unstable due to the arrangement shift in the manufacture and the discharge always stably proceeds to the sustain discharge. Thus, the stable write characteristic operation can be achieved.

Third Embodiment

As mentioned above, the CS structure is adopted in the first embodiment, and the SC electrode structure is adopted in the second embodiment. For this reason, if the non-discharge gap 13 is reduced to a formation limit of the bus electrode interval, a capacitance between the SC electrodes is large, and the charge/discharge current in the sustain period is substantially proportional to the capacitance between the SC electrodes. Thus, the power consumption of the plasma display panel 30 tends to become large. In the third embodiment, the plasma display panel 30 will be described in which the power consumption is reduced over the first and second embodiments. In the plasma display panel 30 according to the third embodiment of the present invention, the description of the same components as those of the first and second embodiments is omitted.

Figure 18:
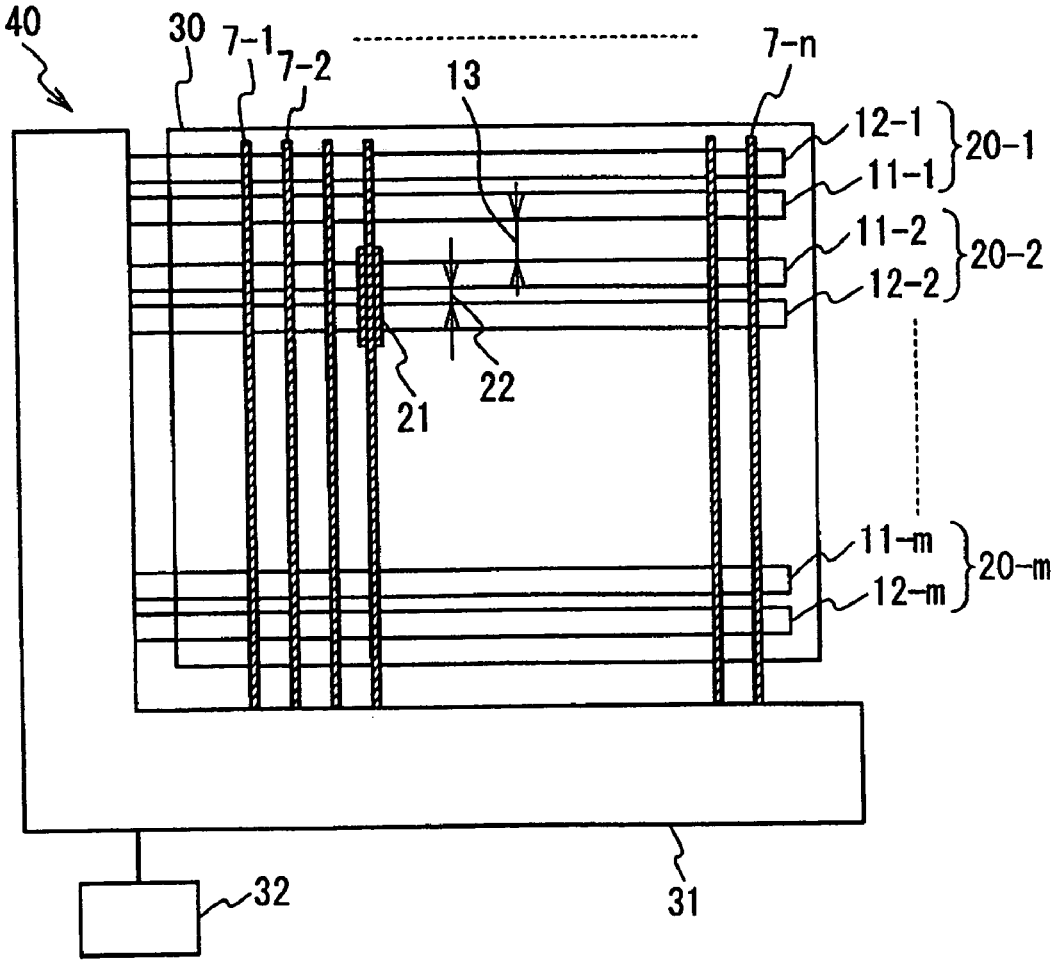
FIG. 18 shows a structure of a plasma display apparatus according to a third embodiment of the present invention.

FIG. 18 shows the structure of the display apparatus 40 to which the plasma display panel 30 according to the third embodiment of the present invention is applied. The surface discharge electrode sets 20-1 to **20-*m*** have two sets of discharge electrodes.

One of the two sets of discharge electrodes is composed of the scan electrodes (S) 12-1, 12-3, 12-5 to **12-(*m*−1) as odd-numbered surface discharge electrode sets 20-1, 20-3, 20-5 to 20-(*m*−1) and the sustain electrodes (C) 11-1, 11-3, 11-5 to 11-(*m*−1) as the odd-numbered surface discharge electrode sets 20-1, 20-3, 20-5 to 20-(*m*−1). The other of the two sets of discharge electrodes is composed of the sustain electrodes (C) 11-2, 11-4, 11-6 to 11-*m* as the even-numbered surface discharge electrode sets 20-2, 20-4, 20-6 to 20-*m* and the scan electrodes (S) 12-2, 12-4, 12-6 to 12-*m* as the even-numbered surface discharge electrode sets 20-2, 20-4, 20-6 to 20-*m***.

In this way, the third embodiment is different from the first and second embodiments in the structure of the surface discharge electrode sets 20-1 to **20-*m* so that the surface discharge electrodes are arranged in the order of SCCSS-CCS . . . (the discharge electrodes 12-1, 11-1, 11-2, 12-2, 12-3, 11-3, 11-4, 12-4, . . . ). Since the SC electrode structure and the CS electrode structure are alternately arranged in the third embodiment, such structure is referred to as the SCCS electrode structure hereinafter. Here, in the SC electrode structure of the SCCS electrode structure, the scan electrodes (S) 12-1, 12-3, 12-5 to 12-(*m*−1) are referred to as S1 electrodes 14, and the sustain electrodes (C) 11-1, 11-3, 11-5 to 11-(*m*−1) are referred to as C1 electrodes 15. Also, in the CS electrode structure of the SCCS electrode structure, the sustain electrodes (C) 11-2, 11-4, 11-6 to 11-*m* are referred to as C2 electrodes 16, and the scan electrodes (S) 12-2, 12-4, 12-6 to 12-*m* are referred to as S2 electrodes 17. The cells 21 corresponding to the SC electrode structure re referred to as first cells 18, and the cells 21 corresponding to the CS electrode structure are referred to as second cells 19**.

Figure 19:
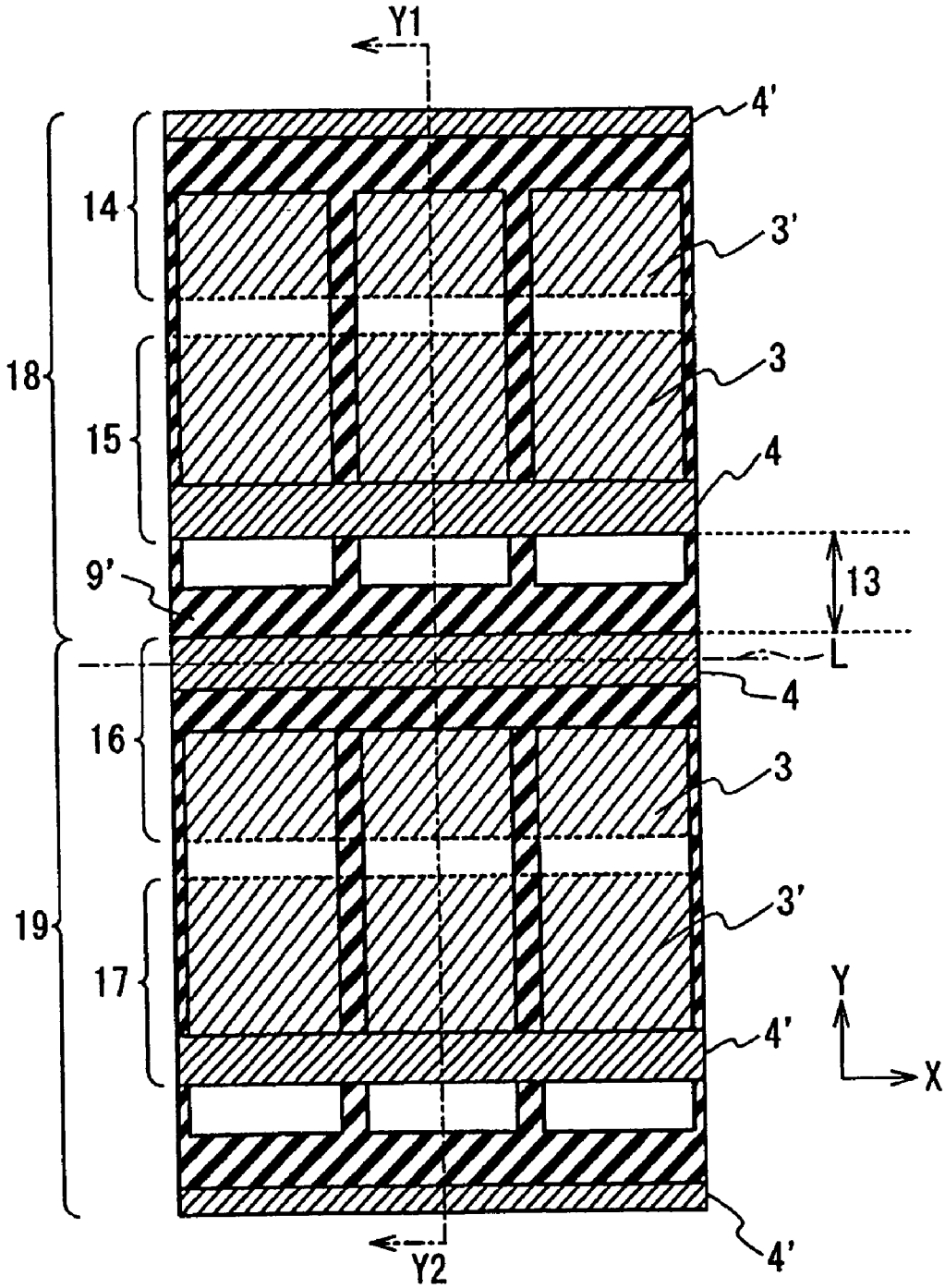
FIG. 19 is a plan view showing a part of the plasma display panel of the plasma display apparatus according to the third embodiment of the present invention.
Figure 20:
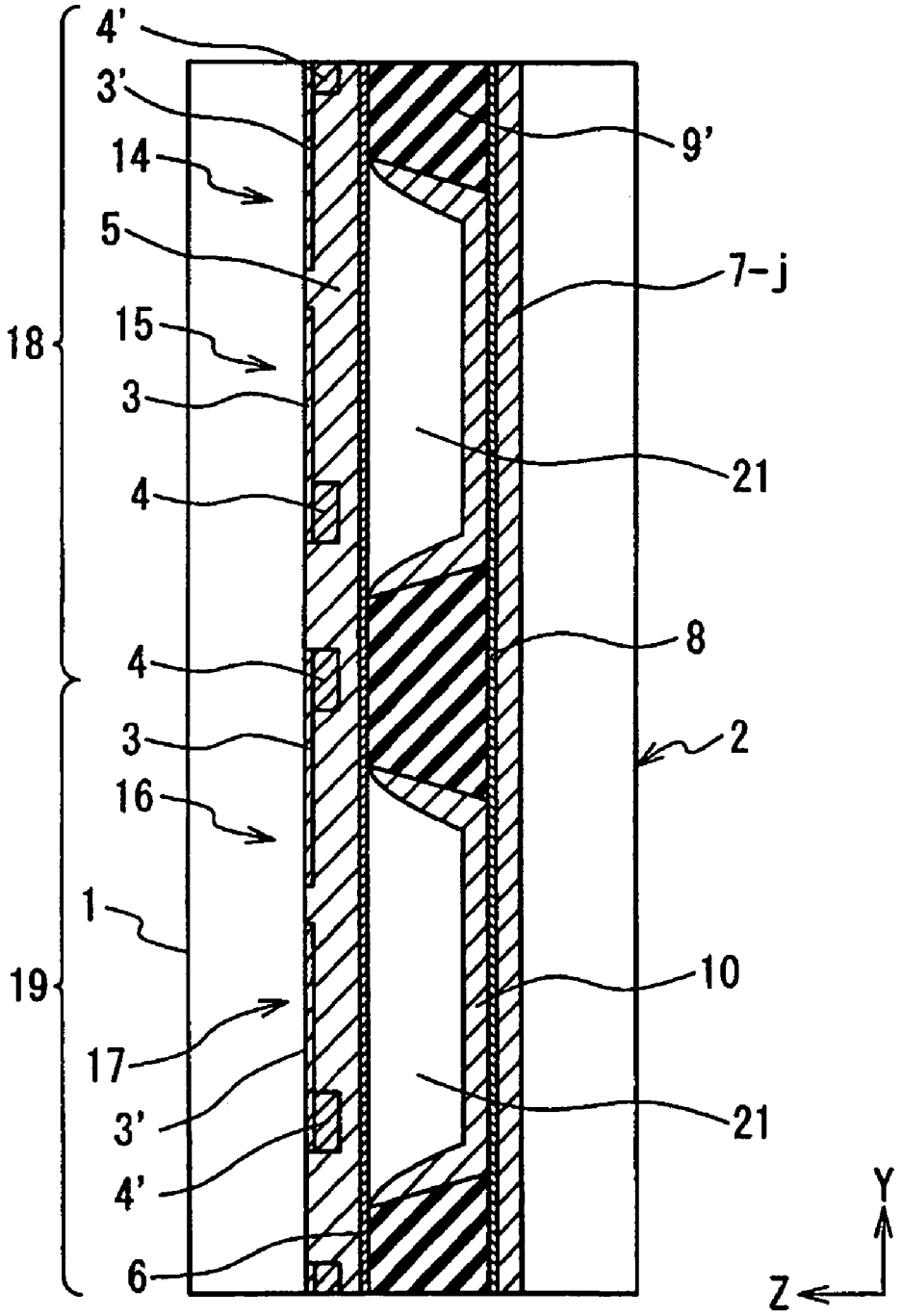
FIG. 20 is a cross sectional view showing the plasma display panel along the Y1-Y2 line in FIG. 19.

FIG. 19 is a plan view a part of the plasma display panel 30 according to the third embodiment of the present invention. FIG. 20 is a cross sectional view of the plasma display panel 30 along the Y1-Y2 line of FIG. 19.

In case of the SCCS electrode structure, the first transparent electrodes 3' of the S1 electrode 14 and the first transparent electrode 3 of the C2 electrode 16 are provided above the cells 21 and the horizontal separation walls 9', and the second transparent electrode 3 of the C1 electrode 15 and the second transparent electrode 3' of the S2 electrode 17 are provided above the cells 21. The first bus electrode 4' of the S1 electrode 14 and the first bus electrode 4 of the C2 electrode 16 are provided above the horizontal separation walls 9', and the second bus electrode 4 of the C1 electrode 15 and the second bus electrode 4' of the S2 electrode 17 are provided above the cells 21.

In a specific example shown in FIG. 19, a first gap is formed between the first transparent electrode 3' of the scan electrode (S) 12-1 and the second transparent electrode 3 of the sustain electrode (C) 11-1 to have the first predetermined distance above the cell 21. Also, the first gap is formed between the first transparent electrode 3 of the sustain electrode (C) 11-2 and the second transparent electrode 3' of the scan electrode (S) 12-2 to have the first predetermined distance above the cell 21. The first transparent electrode 3' of the scan electrode (S) 12-1 is formed above the horizontal separation wall 9', and the first bus electrode 4 is provided above the horizontal separation wall 9' and is connected with the first transparent electrode 3'. The second transparent electrode 3 of the sustain electrode (C) 11-1 is provided above the cell 21 and the second bus electrode 4 is provided to be connected with the second transparent electrode 3.

A second gap is formed between the second bus electrode 4 of the sustain electrode (C) 11-1 and the first bus electrode 4 of the sustain electrode (C) 11-2 to have the second predetermined distance. The second predetermined distance is the distance corresponding to the non-discharge gap 13. The first transparent electrode 3 of the sustain electrode (C) 11-2 is provided above the cell 21 and the horizontal separation wall 9', and the first bus electrode 4 of the sustain electrode (C) 11-2 is provided above the horizontal separation wall 9', and is connected with the first transparent electrode 3 of the sustain electrode (C) 11-2. The second transparent electrode 3' of the scan electrode (S) 12-2 is provided above the cell 21 and the second bus electrode 4' of the scan electrode (S) 12-3 is connected with the second transparent electrode 3' of the scan electrode (S) 12-3 on the cell 21.

The first bus electrodes 4 of the S1 electrode 14 as either of the scan electrodes (S) 12-1, 12-3, 12-5 to 12-($m$−1) and the first bus electrodes 4 of the C2 electrode as either of the sustain electrodes (C) 11-2, 11-4., 11-6 to 11-$m$ are provided above the horizontal separation walls 9' so as to be placed on the center line L of the horizontal separation walls 9'.

As described above, in the plasma display panel 30 according to the third embodiment of the present invention, the advantageous effect can be achieved that the power consumption can be reduced over the first and second embodiments, in addition to the effects of the first and second embodiments.

In the plasma display panel 30 according to the third embodiment of the present invention, the SCCS electrode structure is adopted. Thus, the capacitance can be reduced to about a half, as compared with the CS electrode structure in the first embodiment and the SC electrode structure in the second embodiment. That is, in the CS electrode structure, the scan electrode (S) 12-2 is put between the sustain electrode (C) 11-1 and the sustain electrode (C) 11-2. On the contrary, in the SCCS electrode structure, the S2 electrode 17 (scan electrode 12-2) is put between the S1 electrode 14 (scan electrode 12-3) and the C2 electrode (sustain electrode 11-2) 16. However, the S2 electrode 17 (scan electrode 12-2) and the S1 electrode 14 (scan electrode 12-3) are set to a same voltage in the periods other than the address period. Thus, the capacitance is not generated. Therefore, in the plasma display panel 30 according to the third embodiment of the present invention, the power consumption can be reduced, compared with the first and second embodiments.

In the plasma display panel 30 according to the third embodiment of the present invention, the S1 electrode 14 is provided above the horizontal separation wall 9', and the S2 electrode 17 is provided above the discharge space or the cell 21. Thus, although the write characteristic operation into the second cell 19 is stable, the write characteristic operation into the first cell 18 is unstable. For this reason, in the third embodiment, the S1 electrode for the first cell 18 is scanned, and then the S2 electrode 17 for the second cell 19 is scanned.

Figures 21A, 21B, 21C, 21D, 21E, 21F, 21G, 21H, 21I, 21J:
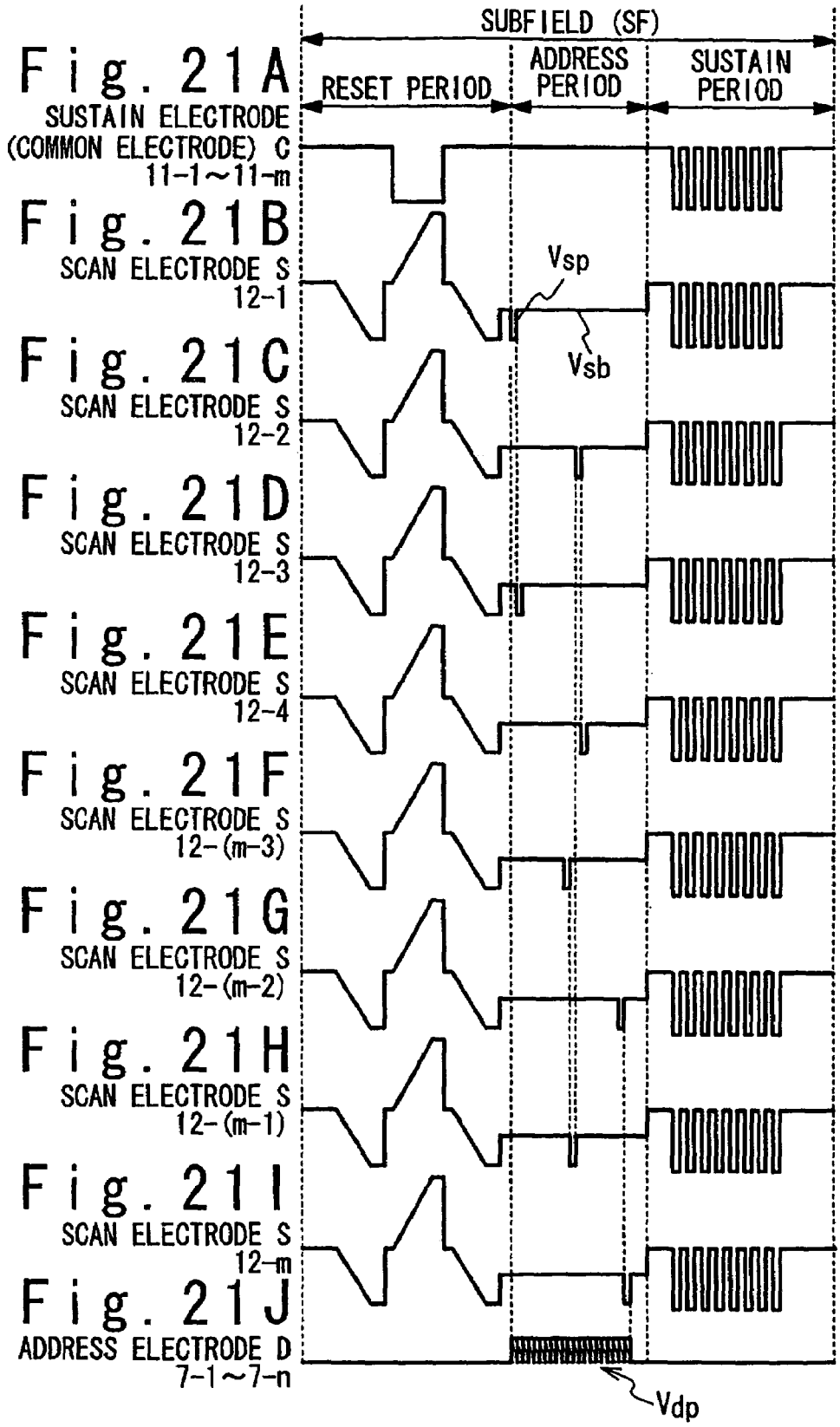
FIGS. 21A to 21J are timing charts showing drive voltage waveforms to drive the plasma display panel of the plasma display apparatus according to the third embodiment of the present invention.

The operation of scanning the S1 electrode 14 for the first cell 18 and then scanning the S2 electrode 17 for the second cell 19 will be described below by using FIG. 21. FIGS. 21A to 21J are timing charts showing the drive voltage waveforms when the plasma display panel 30 according to the third embodiment of the present invention is driven.

In the address period, the control section 32 controls the driver section 31 to scan the S1 electrode 14 for the first cell 18 and then to scan the S2 electrode 17 for the second cell 19. At first, when a scan base voltage Vsb (set voltage) is applied to the scan electrodes (S) 12-1 to 12-$m$, the driver section 31 sequentially applies a scan pulse voltage Vsp (negative voltage pulse) to the scan electrodes (S) 12-1, 12-3, 12-5 to 12-($m$−1) as the S1 electrodes 14 in which the first bus electrodes 4 are provided above the horizontal separation wall 9', to cancel the scan base voltage Vsb. After the scan pulse voltage Vsp is applied to the S1 electrode 14, the driver section 31 sequentially applies the scan pulse voltage Vsp to the scan electrodes (S) 12-2, 12-4, 12-6 to 12-$m$ as the S2 electrodes 17 in which the second bus electrodes 4' are provided above the cell 21.

In the plasma display panel 30 according to the third embodiment of the present invention, the S1 electrode 14 for the first cell 18 is scanned and then the S2 electrode 17 for the second cell 19 is scanned. Therefore, the effect can be achieved that the higher drive stability (variation of drive characteristics in the whole pixels is little) is obtained, compared with the conventional example, in addition to the above-mentioned effects (the decrease in the power consumption)

FOURTH EMBODIMENT

The SCCS electrode structure is adopted in the third embodiment. In the plasma display panel 30 according to the fourth embodiment of the present invention, the CSSC electrode structure is adopted. The effects similar to those of the third embodiment can be obtained even in the CSSC electrode structure. In the plasma display panel 30 according to the fourth embodiment of the present invention, the description of the same components as those of the third embodiment is omitted.

Figure 22:
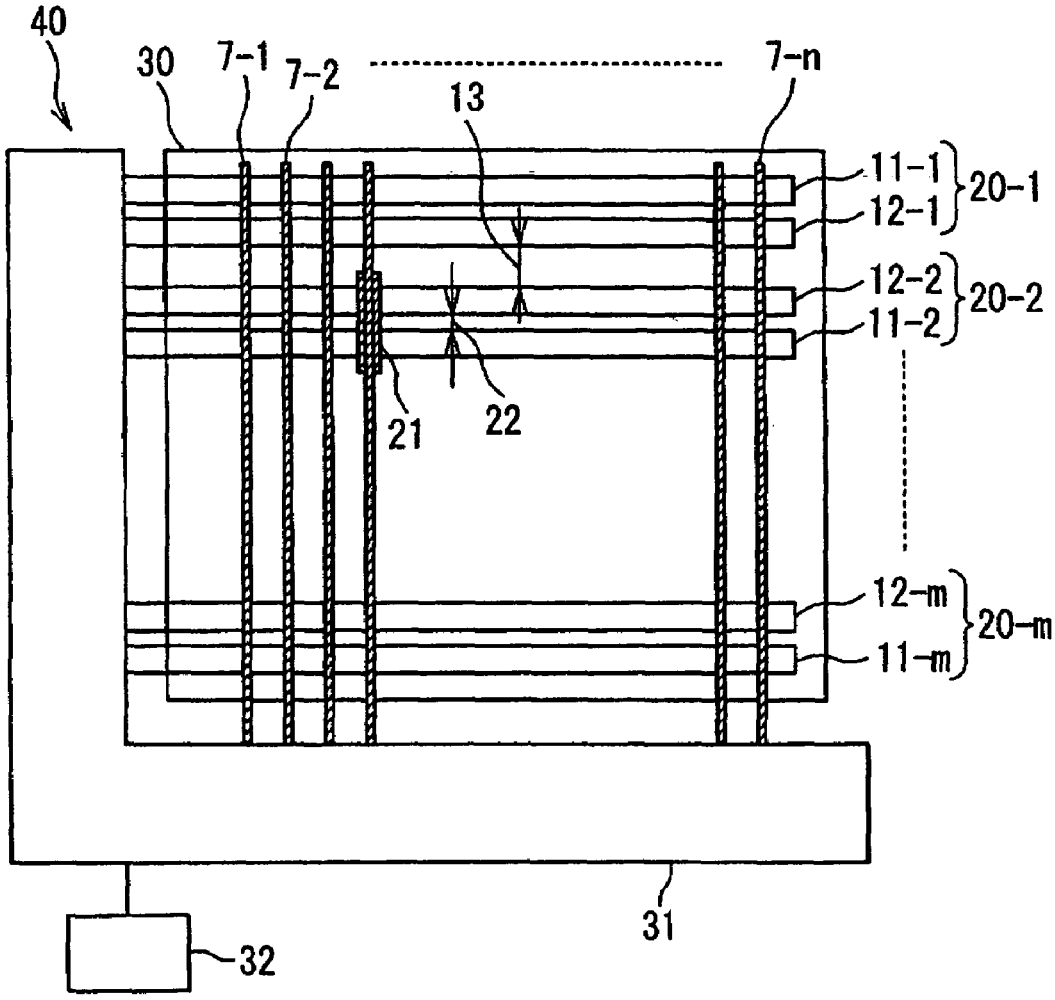
FIG. 22 shows a structure of a plasma display apparatus according to a fourth embodiment of the resent invention.

FIG. 22 shows the structure of the display apparatus 40 to which the plasma display panel 30 according to the fourth embodiment of the present invention is applied. The surface discharge electrode sets 20-1 to 20-$m$ is two sets of discharge electrodes, i.e., one set of discharge electrodes of the sustain electrodes (C) 11-1, 11-3, 11-5 to 11-($m$−1) as the odd-numbered surface discharge electrode sets 20-1, 20-3, 20-5 to 20-($m$−1) and the scan electrodes (S) 12-1, 12-3, 12-5 to 12-$m$ as the odd-numbered surface discharge electrode sets 20-1, 20-3, 20-5 to 20-($m$−1), and the other set of discharge electrodes of the scan electrodes (S) 12-2, 12-4, 12-6 to 12-$m$ as the even-numbered surface discharge electrode sets 20-2, 20-4, 20-6 to 20-$m$ and the sustain electrodes (C) 11-2, 11-4, 11-6 to 11-$m$ as the even-numbered surface discharge electrode sets 20-2, 20-4, 20-6 to 20-$m$.

In this way, the fourth embodiment is different from the third embodiment in the structure of the surface discharge electrode sets 20-1 to **20-*m* that surface discharge electrode are arranged in the order of CSSCCSSC . . . (the discharge electrodes 11-1, 12-1, 12-2, 11-2, 11-3, 12-3, 12-4, 11-4, . . . ). In the structure of the surface discharge electrode sets 20-1 to 20-*m*, the CS electrode structure and the SC electrode structure are alternately arranged. Such a structure is referred to as the CSSC electrode structure. In the CS electrode structure of the CSSC electrode structure, hereinafter, the sustain electrodes (C) 11-1, 11-3, 11-5 to 11-($m-1$) are referred to as C2 electrodes 16, and the scan electrodes (S) 12-1, 12-3, 12-5 to 12-($m-1$) are referred to as S2 electrodes 17. In the SC electrode structure of the CSSC electrode structure, the scan electrodes (S) 12-2, 12-4, 12-6 to 12-*m* are referred to as S1 electrodes 14, and the sustain electrodes (C) 11-2, 11-4, 11-6 to 11-*m* are referred to as C1 electrodes 15. Similarly to the third embodiment, the cells 21 corresponding to the SC electrode structure (the S1 electrode 14 and the C1 electrode 15) are referred to as the first cells 18, and the cells 21 corresponding to the CS electrode structure (the C2 electrode 16 and the S2 electrode 17) are referred to as the second cells 19**.

Figure 23:
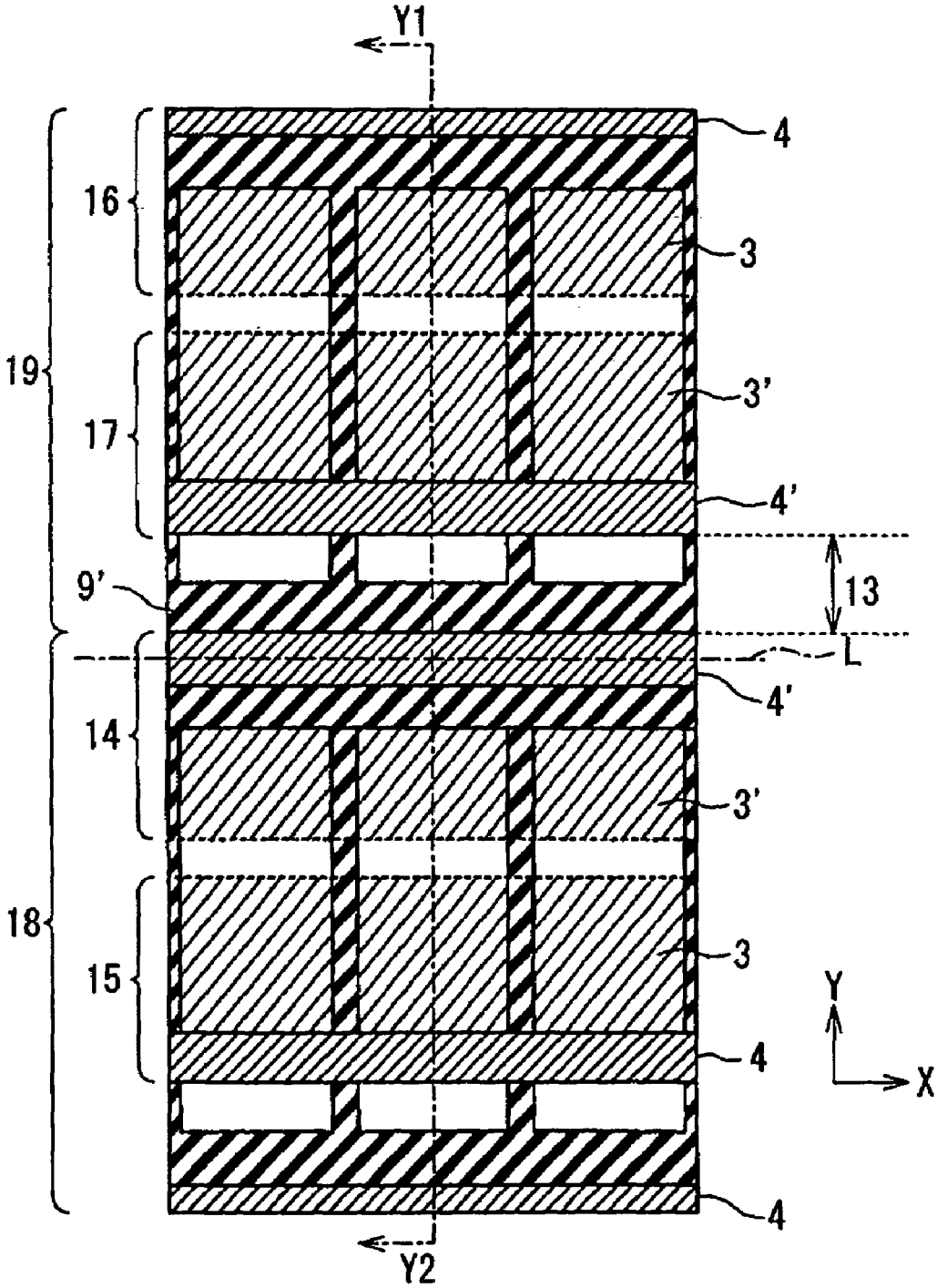
FIG. 23 is a plan view showing a part of the plasma display panel of the plasma display apparatus according to the fourth embodiment of the present invention.
Figure 24:
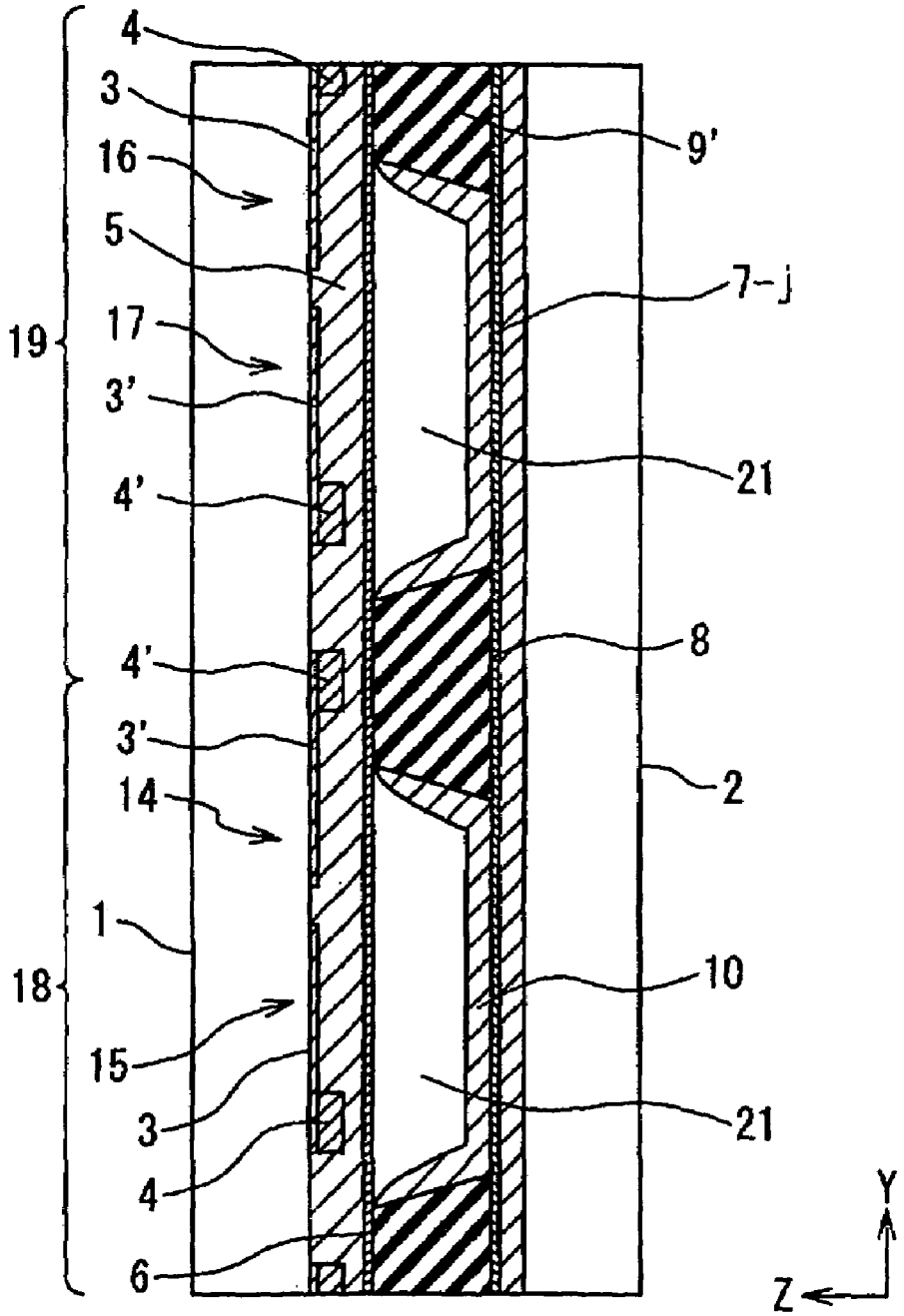
FIG. 24 is a cross sectional view showing the plasma display panel along the Y1-Y2 line in FIG. 23.
Figures 25A, 25B, 25C, 25D, 25E, 25F, 25G, 25H, 25I, 25J:
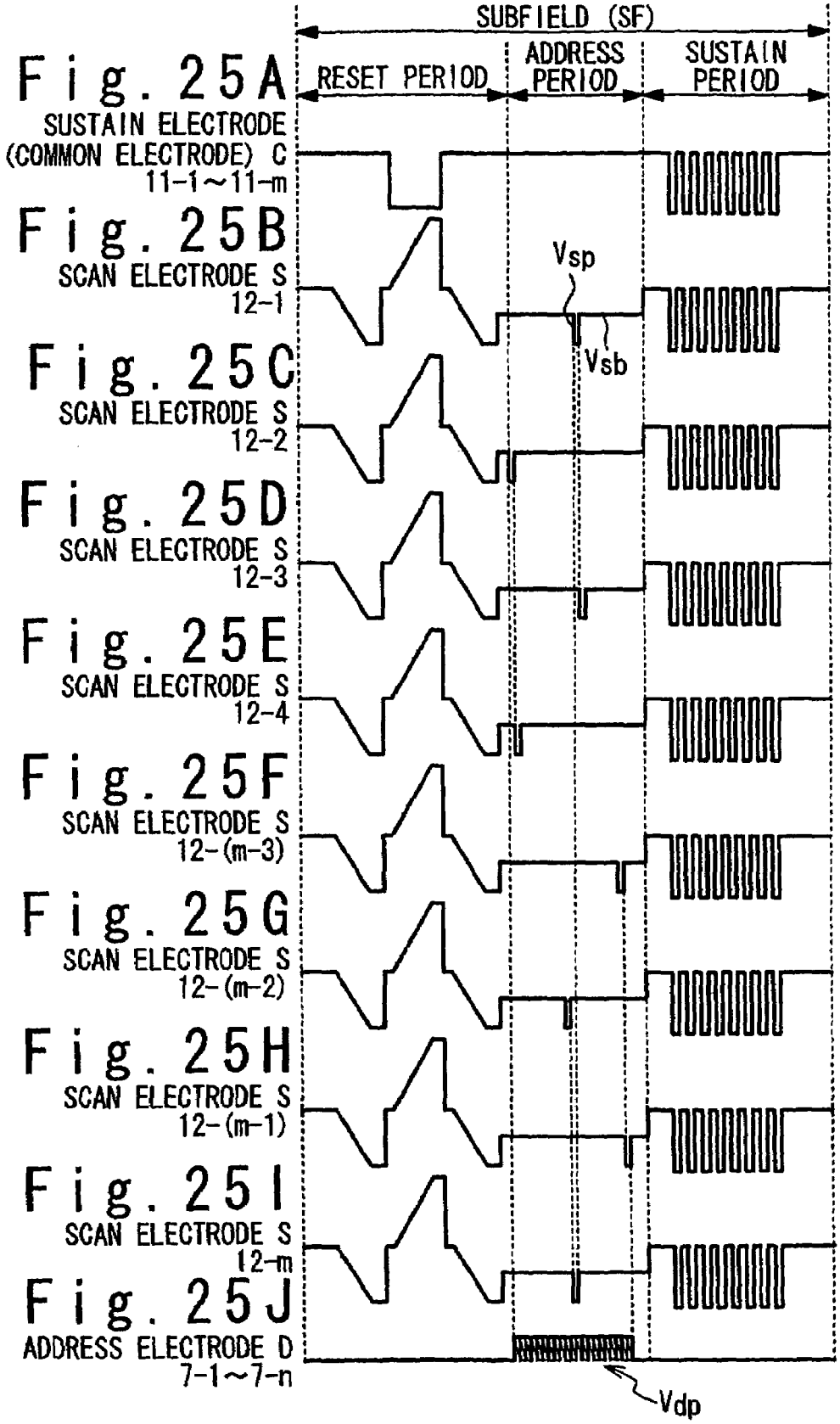
FIGS. 25A to 25J are timing charts showing drive voltage waveforms to drive the plasma display panel of the plasma display apparatus according to the fourth embodiment of the present invention.

FIG. 23 is a plan view a part of the plasma display panel 30 according to the fourth embodiment of the present invention. FIG. 24 is a cross sectional view of the plasma display panel 30 along the Y1-Y2 line of FIG. 23.

In the CSSC electrode structure, the first transparent electrodes 3' of the S1 electrodes 14 and the first transparent electrodes 3 of the C2 electrodes 16 are provided above the cells 21 and the horizontal separation walls 9', and the second transparent electrodes 3 of the C1 electrodes 15 and the second transparent electrodes 3' of the S2 electrodes 17 are provided above the cells 21. The first bus electrodes 4' of the S1 electrodes 14 and the first bus electrodes 4 of the C2 electrodes 16 are provided above the horizontal separation walls 9', and the second bus electrodes 4 of the C1 electrodes 15 and the second bus electrodes 4' of the S2 electrodes 17 are provided above the cells 21.

In a specific example shown in FIG. 23, a first gap is formed between the first transparent electrode 3 of the sustain electrode (C) 11-1 and the second transparent electrode 3' of the scan electrode (S) 12-1 to have the first predetermined distance above the cell 21. Also, another first gap is formed between the first transparent electrode 3 of the scan electrode (S) 12-2 and the second transparent electrode 3' of the sustain electrode (C) 11-2 to have the first predetermined distance above the cell 21. A part of the first transparent electrode 3 of the sustain electrode (C) 11-1 is formed on the horizontal separation wall 91, and the first bus electrode 4 of the sustain electrode (C) 11-1 is provided above the horizontal separation wall 9' to be connected with the part. The second transparent electrode 3' of the scan electrode (S) 12-1 is provided above the cell 21 and the second bus electrode 4' of the scan electrode (S) 12-1 is provided above the cell 21 to be connected with a part of the second transparent electrode 3'.

A second gap is formed between the second bus electrode 4' of the scan electrode (S) 12-1 and the first bus electrode 4 of the scan electrode (S) 12-2 to have the second predetermined distance. The second predetermined distance is the distance corresponding to the non-discharge gap 13. A part of the first transparent electrode 3' of the scan electrode (S) 12-2 is provided above the horizontal separation wall 9', and the first bus electrode 4 of the scan electrode (S) 12-2 is provided above the horizontal separation wall 9' to be connected with the part. The second transparent electrode 3' of the scan electrode (S) 11-2 is provided above the cell 21, and the second bus electrode 4' of the scan electrode (S) 11-2 is connected with a part of the second transparent electrode 3' above the cell 21. The second bus electrode 4 of the sustain electrode (C) 11-2 is provided above the cell 21 to be connected with the second transparent electrode 3 of the sustain electrode (C) 11-2.

The first bus electrodes 41 of the S1 electrode 14 as either of the scan electrodes (S) 12-2, 12-4, 12-6 to **12-*m* and the first bus electrodes 4 of the C2 electrode as either of the sustain electrodes (C) 11-1, 11-3, 11-5 to 11-($m-1$) are provided above the horizontal separation walls 9'** so as to overlap on the center line L.

As described above, in the plasma display panel 30 according to the fourth embodiment of the present invention, the power consumption can be reduced compared with the first and second embodiments, similarly to the third embodiment.

In the plasma display panel 30 according to the fourth embodiment of the present invention, similarly to the third embodiment, the S1 electrodes 14 are provided above the horizontal separation walls 9', and the S2 electrodes 17 are provided above the discharge spaces or the cells 21. Thus, although the write characteristic operation into the second cell 19 is stable, the write characteristic operation of the first cell 18 becomes unstable. For this reason, similarly to the third embodiment, in the fourth embodiment, the S1 electrode for the first cell 18 is scanned, and then the S2 electrode 17 for the second cell 19 is scanned.

An operation of for scanning the S1 electrode 14 for the first cell 18 and then scanning the S2 electrode 17 for the second cell 19 will be described below with reference to FIGS. 25A to 25J. FIGS. 25A to 25J are timing charts showing the drive voltage waveform when the plasma display panel 30 according to the fourth embodiment of the present invention is driven.

In the address period, similarly to the third embodiment, the control section 32 controls the driver section 31 to scan the S1 electrodes 14 for the first cells 18 and then to scan the S2 electrodes 17 for the second cells 19. The scan base voltage Vsb (set voltage) is applied to the scan electrodes (S) 12-1 to **12-*m*. In this case, at first, the driver section 31 sequentially applies the scan pulse voltage Vsp (negative pulse) to the scan electrodes (S) 12-2, 12-4, 12-6 to 12-*m* as the S1 electrodes 14, in which the first bus electrodes 4 are provided above the horizontal separation walls 9', to cancel the scan base voltage Vsb (set voltage). After the scan pulse voltage Vsp (negative pulse) is applied to the S1 electrodes 14, the driver section 31 sequentially applies the scan pulse voltage Vsp to the scan electrodes (S) 12-1, 12-3, 12-5 to 12-($m-1$) as the S2 electrodes 17, in which the second bus electrodes 4' are provided above the cells 21**. Thus, a data pulse voltage Vdp (write pulse) is applied.

In the plasma display panel 30 according to the fourth embodiment of the present invention, the S1 electrodes 14 for the first cells 18 are scanned and then the S2 electrode 17 for the second cells 19 are scanned. Therefore, the effect that the drive stability higher than a conventional example can be obtained over the entire cells, in addition to the above-mentioned effect, i.e., reduction of power consumption.

The reason why the higher drive stability can be achieved in the third and fourth embodiments will be described in detail.

Generally, the write characteristic operation is better in the first portion of the address period, and poorer in the second portion thereof. The first portion of the address period is closer to the reset period, and many active particles (priming particles) generated in the reset period remains. Therefore, the discharge probability is very high (the priming effect), to make the write discharge easy. However, in the second portion of the address period, the priming particles at the active state are gradually shifted to the stable state, to reduce the discharge probability. Therefore, the write discharge is hard to generate, and the write characteristic operation becomes poorer.

Also, the wall charges are generated in the reset period by the driver section 31 and the control section 32 so that the write discharge is easy to be caused. The scan pulse voltage Vsp is applied to the scan electrodes (S) 12-1 to **12-*m*, and the write pulse (the data voltage pulse Vdp) is applied to the address electrodes (D) 7-1 to 7-*n* in the address period. Thus, the write discharge is caused. However, actually, even if the scan voltage pulse Vsp is not applied, the weak write discharge (erroneous write) is caused since the data pulse voltage Vdp functions as a trigger. This erroneous write is likely to be caused when the amplitude of the write pulse (data pulse voltage Vdp) is larger than the amplitude of the scan pulse voltage Vsp or when the priming effect of the first portion of the address period is large. Once the erroneous write is caused, even if the scan pulse voltage Vsp is applied to the scan electrodes (S) 12-1 to 12-*m* so that the write pulse (data pulse voltage Vdp) is applied to the address electrodes (D) 7-1 to 7-*n***, the discharge of the erroneous write removes the wall charges generated to easily cause the write discharge in the reset period. For this reason, the probability of the write fault becomes very high. Hereafter, this is referred to as a weak discharge type write fault.

This weak discharge type write fault is easy to be caused in the second portion of the address period. This is because in the second portion of the address period, the number of time of the application of the write pulse (data pulse voltage Vdp) to another cells is more. As a specific example, it is supposed that the number of the scan lines in the entire panel is 400 (in this case, the scan electrodes (S) 12-1 to 12-400). In this case, until the final 400-th scan line (the scan electrode (S) 12-400 in the third embodiment, and the scan electrode (S) 12-399 in the fourth embodiment) is scanned, the write pulses (data pulse voltage Vdp) which functions as the trigger of the erroneous write is applied 399 times in the worst case.

As mentioned above, the write characteristic operation is better in the first portion of the address period, and poorer in the second portion thereof.

In the conventional plasma display panel 130, it is impossible to avoid that the cells with the poor write characteristic are generated because of variation in the manufacture. Thus, when the write operation is carried out on the cells with the poor write characteristic in the second portion of the scan period, the write characteristic is largely varied over the whole of the panel. On the contrary, in the plasma display panel 30 according to the third and fourth embodiments of the present invention, the S1 electrodes 14 for the first cells 18 are scanned in the first portion of the address period, although the S1 electrodes 14 have the poor write characteristic because the first bus electrodes 4 of the scan electrodes are provided above the horizontal separation walls 9'. Thus, the poorness of the write characteristic depending on the structure can be compensated by the driving method. Also, the S2 electrodes 17 for the second cells 19 are scanned in the second portion of the address period, since the second bus electrodes 4' for the second cells 19 are provided above the discharge spaces or the cells 21 so that the write characteristic operation is good. Therefore, the poorness of the write characteristic on the drive can be compensated by the panel structure. For these reasons, the write characteristic operation can be averaged over the whole of the first and second cells 18 and 19 in the panel. Therefore, the write characteristics of the whole panel can be further improved over the conventional example. The improvement effect of the write characteristic on the entire panel will be described below as the effect of the high drive stability as mentioned above.

In the conventional plasma display panel 130, when the scan voltage pulse Vsp is applied to the scan electrodes (S) 112-1 to **112-*m* and the write data voltage pulse Vdp is applied to the address electrodes (D) 107-1 to 107-*n*, the write discharge is not immediately caused, and the write discharge is caused after the delay of several μs from the application of pulses. For example, when the scan pulse voltage Vsp is applied to the scan electrode (S) 112-1 as shown in FIG. 26B, and the write data voltage pulse Vdp is applied to the address electrode (D) 107-*j*, as shown in FIG. 26C, the write discharge in the cell 121 corresponding to the scan electrode (S) 112-1 and the address electrode (D) 107-*j* is caused after the delay of several μs from the application, as shown in FIGS. 27A to 27**C. In this way, the light emission is carried out after the delay of several μs, and this delay time is defined as DLT (μs).

Figure 28:
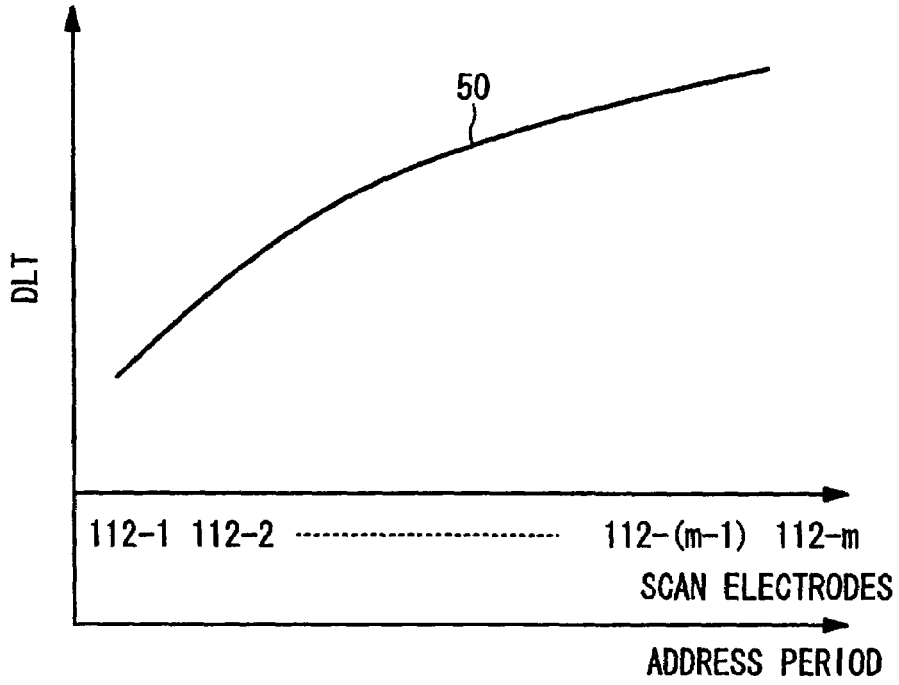
FIG. 28 is a diagram showing a relation between an address period and DLT in the conventional plasma display apparatus.
Figure 29:
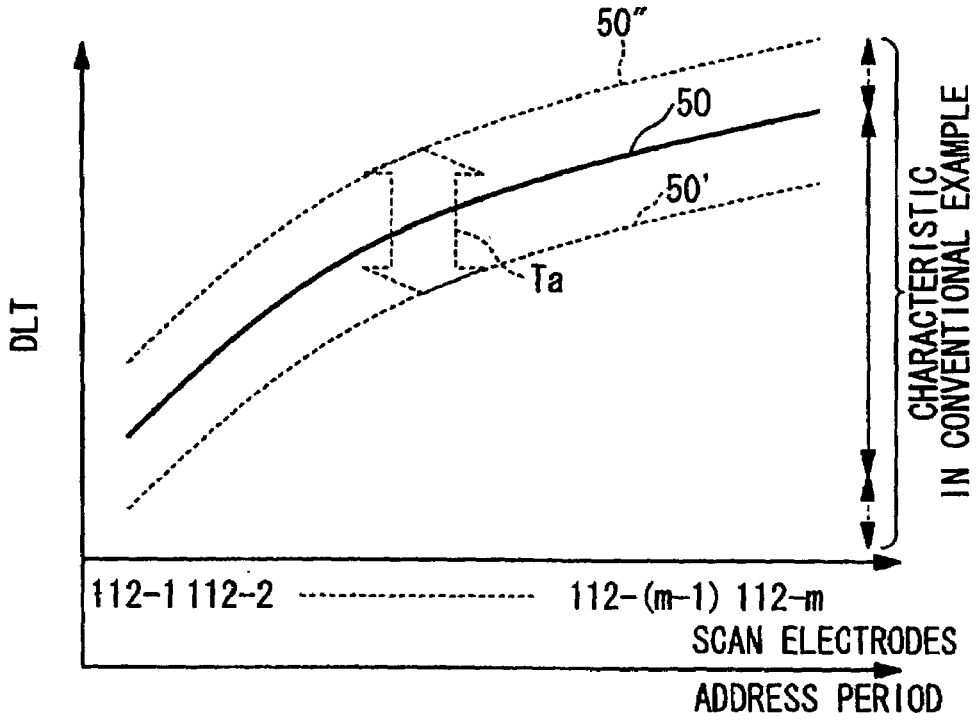
FIG. 29 is a view showing a relation between an address period and DLT used to explain a part of effects of the plasma display apparatus of the present invention.

As shown in FIG. 28, in the conventional plasma display panel 130, as the scan voltage pulse Vsp is sequentially applied to the scan electrodes (S) 112-1 to **112-*m* in the address period, the delay time DLT 50 becomes larger. That is, from the beginning of the address period to the end thereof, the delay time DLT 50 becomes gradually larger. As shown in FIG. 29, in the conventional plasma display panel 130, the above-mentioned delay time DLT 50 largely depends on the variation in the manufacture, and varies within a variation time Ta from a delay time DLT 50' to a delay time DLT 50" with respect to the above-mentioned delay time DLT 50** as a center.

If the delay time DLT 50 becomes larger than the pulse width of the scan voltage pulse Vsp or the write data voltage pulse Vdp as a first limit time, the write discharge is not caused, and the sustain discharge is not naturally caused. As a result, the write fault occurs and the image quality is degraded. Also, if the delay time DLT 50 is excessively smaller than a second limit time, the occurrence probability of the above-mentioned weak discharge type write fault is high. As a result, the image quality is also degraded. This phenomenon is severer in the higher fineness panel in which the number of the scan lines is greater. In short, in order to improve the write characteristic of the entire panel, it is desired that the absolute value of the delay time DLT 50 is sufficiently small and the variation time Ta is made shorter such that the absolute value of the delay time DLT 50 does not become excessively smaller than the second limit time, when the variation time Ta is considered.

Figure 30:
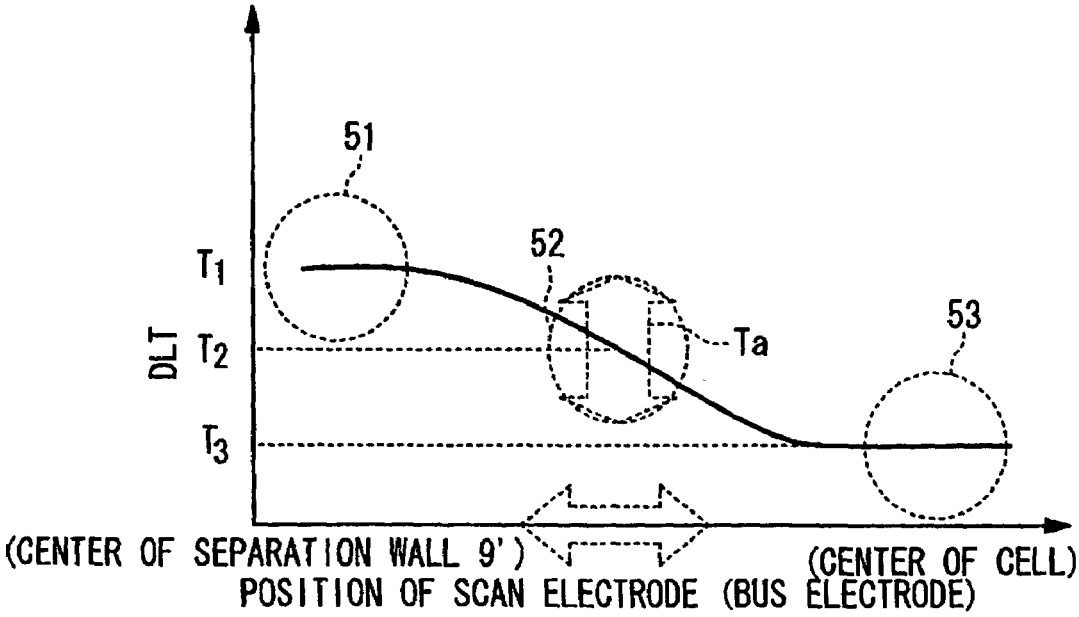
FIG. 30 is a diagram showing a relation between a position of a bus electrode of a scan electrode and DLT, used to explain a part of effects of the plasma display apparatus of the present invention.

As shown in FIG. 30, in the conventional plasma display panel 130, it is supposed that the write characteristic of the cell 121 on the k-th row (k=1, 2, 3 to m) is a write characteristic 52 and the delay time DLT in the write characteristic 52 is DLT [$T_2$]. Also, in the SC electrode structure of the plasma display panel 30 of the present invention, it is supposed that the write characteristic of the cell 21 on a g-th row is a write characteristic 51, and the delay time DLT in the write characteristic 51 is DLT [$T_1$]. In the second embodiment, g is represented by g=1, 2, 3 to m. In the third embodiment, g is represented by g=1, 3, 5 to m−1. In the fourth embodiment, g is represented by g=2, 4, 6 to m.

In the conventional plasma display panel 130, the bus electrode 104 of the scan electrode (S) **112-*k* is provided above the cell 121 and the horizontal separation wall 109'**.

On the contrary, in the SC electrode structure of the plasma display panel 30 of the present invention, the first bus electrode 4 of the scan electrode 12-*g* is provided above the horizontal separation wall 9' Therefore, the delay time DLT [$T_1$] is greater than the delay time DLT [$T_2$]. Also, in the CS electrode structure of the plasma display panel 30 of the present invention, it is supposed that the write characteristic of the cell 21 on the g-th row is a write characteristic 53, and the delay time DLT in the write characteristic 53 is DLT [$T_3$] In the first embodiment, g is represented by g=1, 2, 3 to m. In the third embodiment, g is represented by g=2, 4, 6 to m. In the fourth embodiment, g is represented by g=1, 3, 5 to m−1.

In the conventional plasma display panel 130, the bus electrode 104 of the scan electrode (S) 112-*k* is provided above the cell 121 and the horizontal separation wall 109'. On the contrary, in the CS electrode structure of the plasma display panel 30 of the present invention, the first bus electrode 41 of the scan electrode 12-*g* is provided above the cell 21, and the delay time DLT [$T_3$] is smaller than the delay time DLT [$T_2$].

At first, the improvement effect of the write characteristic of the entire panel in the plasma display panel 30 according to the first embodiment of the present invention will be described.

Figure 31:
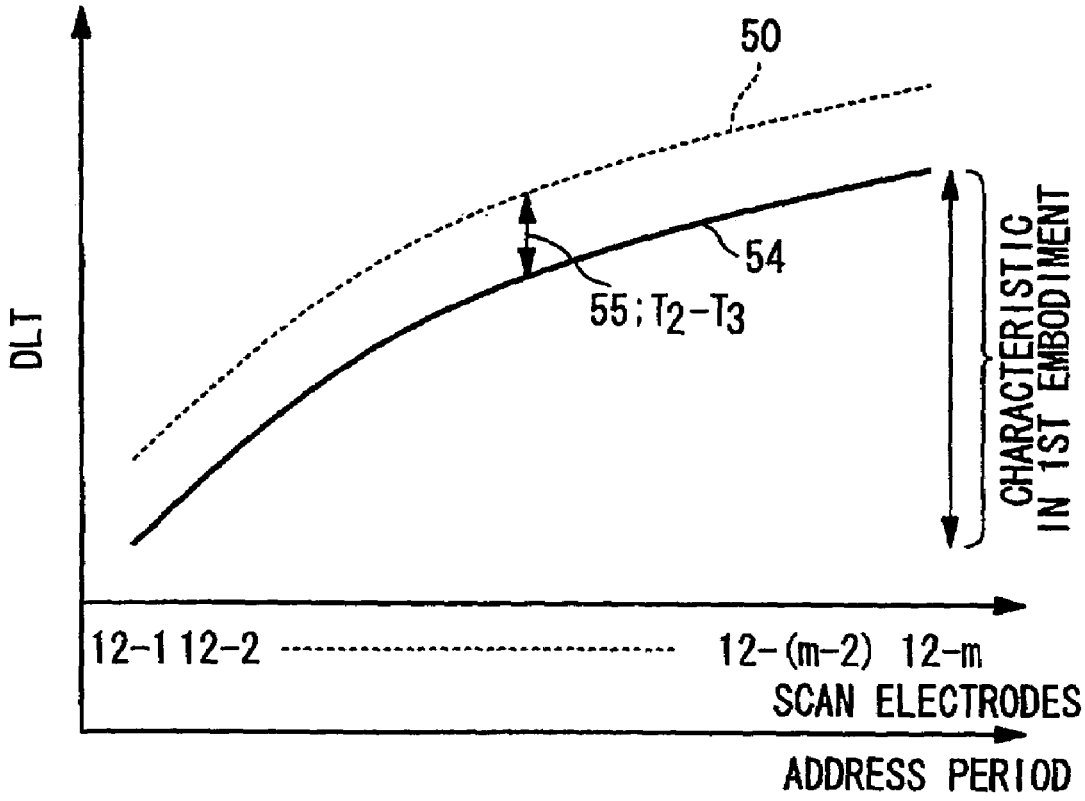
FIG. 31 is a diagram showing a relation between an address period and DLT in the plasma display apparatus according to the first embodiment of the present invention.

As shown in FIG. 31, in the first embodiment, as the scan electrodes (S) 12-1 to 12-*m* are sequentially scanned in the address period, the delay time DLT 54 becomes larger. The absolute value of the delay time DLT 54 is smaller by a difference time 55 than the absolute value of the delay time DLT 50. The difference time 55 is obtained by subtracting the delay time DLT [$T_3$] from the delay time DLT [$T_2$]. In this way, in the first embodiment, the improvement effect of the write characteristic in the entire panel is achieved, as the absolute value of the delay time DLT 54 improved by the difference time 55 as compared with the absolute value of the delay time DLT 50. Also, in the plasma display panel 30 of the present invention, the variation time Ta is made shorter, as the improvement effect of the write characteristic in the entire panel, the adoption of the electrode structure of the first embodiment. Consequently, in the plasma display panel 30 according to the first embodiment of the present invention, the absolute value of the delay time DLT 54 is sufficiently smaller than that of the conventional plasma display panel 130, and the variation time Ta is made shorter. That is, there is no case that the absolute value of the delay time delay time DLT 54 is made excessively smaller than the second limit time because of the variation time Ta.

In the first embodiment in which the bus electrode of the sustain electrode is provided above the horizontal separation wall, the effect is accomplished in case of the poor write characteristic. On the contrary, in the second embodiment in which the bus electrode of the scan electrode is provided above the horizontal separation wall, the effect is accomplished in case of the excessively excellent write characteristic. In short, when the write characteristic is excessively excellent or poor, the trouble occurs. That is, there is an optimal value (range) in the write characteristic. In the third and fourth embodiments, the variations in their write characteristic fall in the above-mentioned optimal range.

The improvement effect of the write characteristic operation in the entire panel in the plasma display panel 30 according to the third and fourth embodiments of the present invention will be described below by exemplifying the third embodiment.

Figure 32:
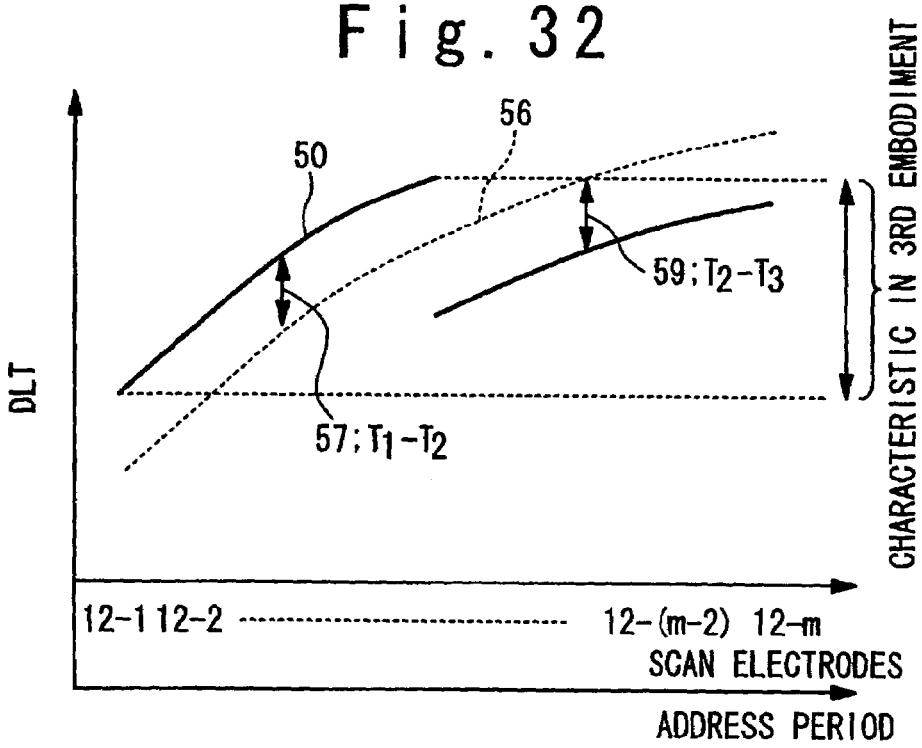
FIG. 32 is a diagram showing a relation between an address period and DLT in the plasma display apparatus according to the third embodiment of the present invention.

As shown in FIG. 32, in the third embodiment, as the scan electrodes (S) 12-1, 12-3, 12-5 to 12-(*m*−1) are sequentially scanned in the address period, the delay time DLT 56 becomes larger. In the first portion of the address period, the absolute value of the delay time DLT 56 is smaller by a difference time 57 than the absolute value of the delay time DLT 50. The difference time 57 is the time in which a second difference time is subtracted from a first difference time. The first difference time is the time in which the delay time DLT resulting from the write characteristic into the cell 21 on the (m/2)-th row as the central row is subtracted from the delay time DLT resulting from the write characteristic into the cell 21 on the m-th row as the final row. The second difference time is the time in which the delay time DLT [$T_2$] is subtracted from the delay time DLT [$T_1$]. In this way, in the case of the third embodiment, in the first portion of the address period, the improvement effect of the write characteristic operation in the entire panel is achieved, and the absolute value of the delay time DLT 56 is improved by the deference time 57 as compared with the absolute value of the delay time DLT 50. Also, due to the electrode structure of the third embodiment, in the first portion of the address period, the improvement effect of the write characteristic in the entire panel is accomplished and the above-mentioned first difference time within the difference time 57 and the variation time Ta are reduced.

Consequently, in the plasma display panel 30 according to the third embodiment (fourth embodiment) of the present invention, in the first portion of the address period, the absolute value of the delay time DLT 56 is sufficiently smaller than that of the conventional plasma display panel 130, and the variation time Ta is reduced (the variation time Ta does not cause the absolute time to be excessively smaller than the second limit time).

Figure 33:
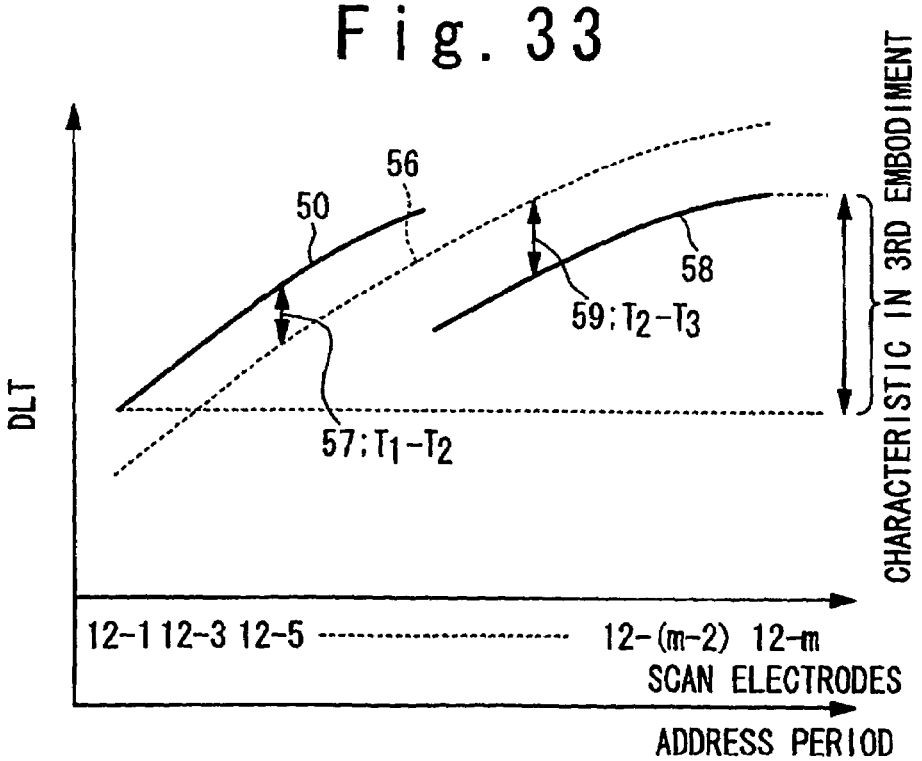
FIG. 33 is a view showing a relation between an address period and DLT in the plasma display apparatus according to the third embodiment of the present invention, which is used to explain a part of effects of the plasma display apparatus of the present invention.

As shown in FIG. 33, in the second portion of the address period, the absolute value of a delay time DLT 58 is smaller by a difference time 59 than the absolute value of the delay time DLT 56. The difference time 59 is the time in which the delay time DLT [$T_3$] is subtracted from the delay time DLT [$T_2$]. In this way, in the third embodiment, in the second portion of the address period, the improvement effect of the write characteristic in the entire panel is accomplished, and the absolute value of the delay time DLT 59 is improved by the difference time 59 as compared with the absolute value of the delay time DLT 56.

Also, through the adoption of the electrode structure of the third embodiment, in the second portion of the address period, the improvement effect of the write characteristic in the entire panel is accomplished, and the time in which the delay time DLT [$T_3$] is subtracted from the delay time DLT [$T_2$] and the variation time Ta are reduced.

Consequently, in the plasma display panel 30 according to the third embodiment (fourth embodiment) of the present invention, in the second portion of the address period, the absolute value of the delay time DLT 58 is sufficiently smaller than that of the conventional plasma display panel 130, and the variation time Ta is reduced (the variation time Ta does not cause the absolute time to be excessively smaller than the second limit time).

Fifth Embodiment

As mentioned above, in the CS electrode structure in the first embodiment, irrespectively of the variation in the manufacture, the first bus electrodes 4 of the sustain electrodes (C) 11-1 to 11-*m* are formed such that the first bus electrodes 4 are above the horizontal separation walls 9', and the second bus electrodes 4' of the scan electrodes (S) 12-1 to 12-*m* are formed such that the second bus electrodes 4' are above the discharge space (refer to FIGS. 12 and 13). In this case, a part of the first transparent electrode 3 of each of the sustain electrodes (C) 11-1 to **11-*m* is formed above the discharge space, and the other part thereof is formed above the horizontal separation wall 9'. Thus, the area where the first transparent electrode 3 overlaps above the discharge space and the area where it overlaps above the horizontal separation wall 9' are varied due to the variation in the manufacture. Similarly, a part of the second transparent electrode 3' of each of the scan electrodes (S) 12-1 to 12-*m* is formed above the discharge space, and a part thereof is formed above the horizontal separation wall 9'. Therefore, the area where the second transparent electrode 3' overlaps above the discharge space and the area where it overlap on the horizontal separation wall 9' are varied due to the variation in the manufacture. As a result, the variation in the manufacture causes the write characteristic and the sustain discharge property to be varied. The plasma display panel 30** according to the fifth embodiment of the present invention copes with the above-mentioned problems.

Figure 34:
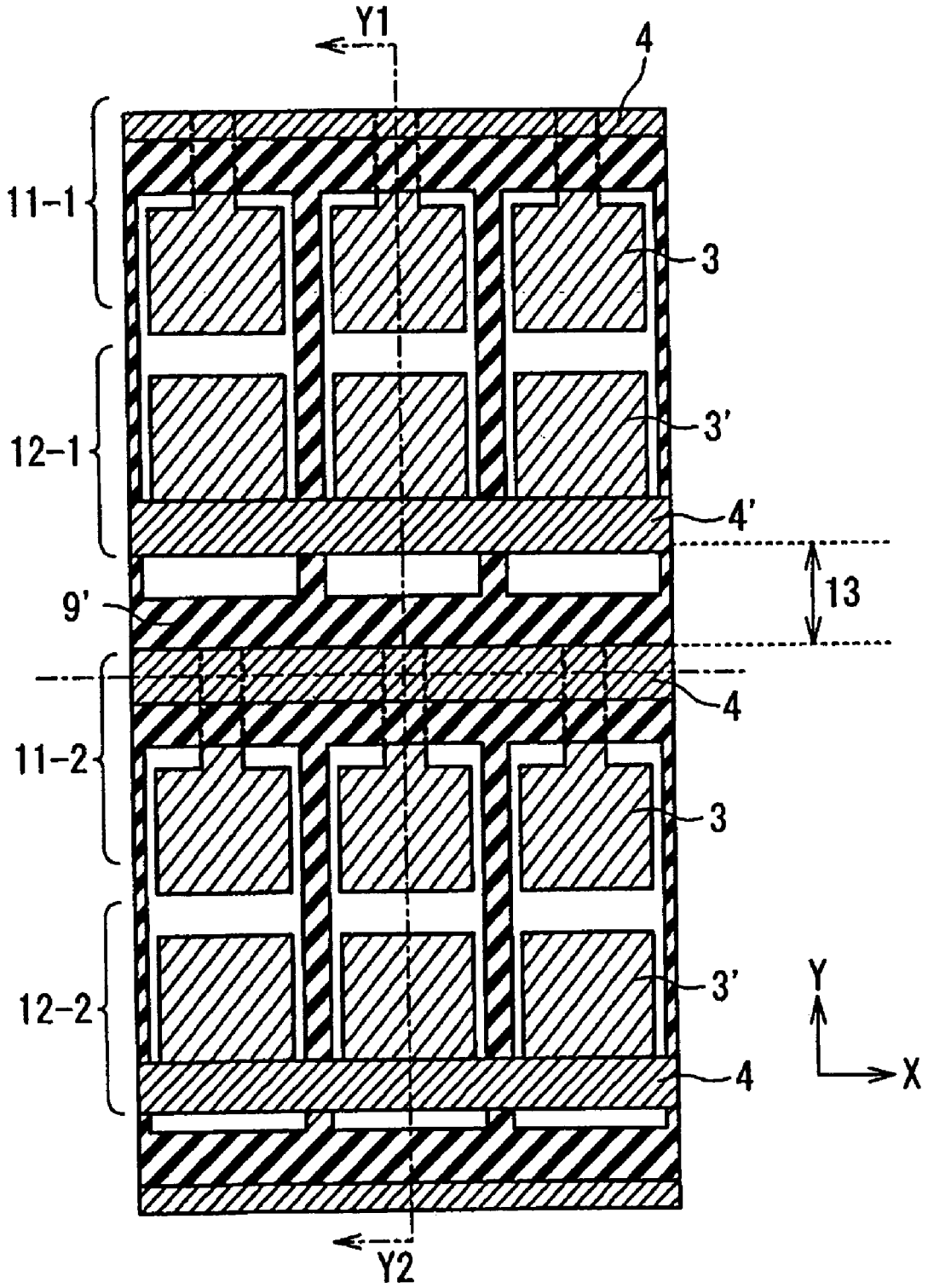
FIG. 34 is a plan view showing a part of the plasma display apparatus according to a fifth embodiment of the present invention.
Figures 35A, 35B, 35C:
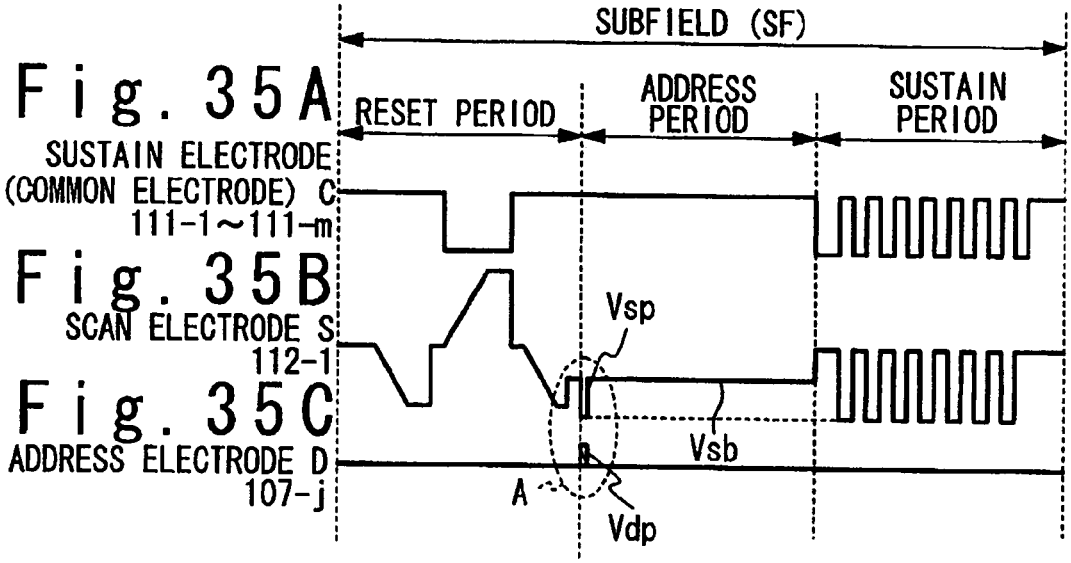
FIGS. 35A to 35C are timing charts showing drive voltage waveforms used to explain the plasma display apparatus according to the fifth embodiment of the present invention.

In the fifth embodiment, the CS electrode structure shown in FIG. 12 is modified to a CS electrode structure shown in FIG. 34. That is, the width of the first transparent electrode 3 in the row direction is made shorter near the first bus electrode 4 than the width of the first transparent electrode 3 in the row direction near the discharge gap 22. Here, the area of the first transparent electrode 3 is substantially equal to the area of the second transparent electrode 3'. Such a shape can reduce the influence of the variation in the column direction in mating the front substrate 1 and the back substrate 2.

It should be noted that the shape of the first transparent electrode 3 in the fifth embodiment can be applied to the second to fourth embodiments in addition to the first embodiment. As shown in FIG. 34, when the first bus electrode 4 of the sustain electrode (C) overlaps on the horizontal separation wall 9', the width of the first transparent electrode 3 of the sustain electrode (C) in the row direction near the first bus electrode 4 is made shorter than the width of the first transparent electrode 3 of the sustain electrode (C) in the row direction near the discharge gap 22. This may be applied to the first, third and fourth embodiments. On the other hand, when the first bus electrode 4 of the scan electrode (S) overlaps above the horizontal separation wall 9', the width of the first transparent electrode 3 of the scan electrode (S) in the row direction near the first bus electrode 4 is made shorter than the width of the first transparent electrode 3 of the scan electrode (S) in the row direction near the discharge gap 22. This may be applied to the second, third and fourth embodiments.

In the first to fourth embodiments, when the first bus electrode 4 overlaps above the horizontal separation wall 9', the effect that it is possible to stably produce the plasma display panel having the predetermined write characteristic through the adoption of the design of the above-mentioned shape of the first transparent electrode 3 can be achieved, since an area difference of the discharge electrode provided in the discharge space is small even in case of the occurrence of deviation in the column direction, in addition to the effects of those embodiments.

In the above first to fourth embodiments, the separation walls are provided above the back substrate. However, the separation walls may be provided above the front substrate. Because this could be understood to the person in the art, the description is omitted.

As described above, even if there is the variation in the manufacture, the plasma display apparatus using the plasma display panel 30 of the present invention is more stable in write characteristic than the conventional plasma display apparatus. In particular, independently of the number of the scan lines, it is more stable in the write characteristic than the conventional plasma display apparatus.

What is claimed is:

1. A plasma display panel of an AC 3-electrode plane discharge type, comprising:

a front substrate;

a back substrate;

a plurality of electrode pairs of a first plane discharge electrode and a second plane discharge electrode formed on said front substrate to extend to a row direction;

a plurality of address electrodes formed on said back substrate to extend in a column direction so as to provide a plurality of discharge cells such that said discharge cells are respectively positioned at intersections between said electrode pairs and said address electrodes to form a matrix;

a plurality of row separation walls formed on said back substrate or said front substrate and said plurality of address electrodes to extend in said row direction such that each row of said discharge cells is defined by two of adjacent row separation walls; and a plurality of column separation walls formed on said back substrate or said front substrate to extend in said column direction such that each column of said discharge cells is defined by two of adjacent column separation walls;

wherein each of said first plane discharge electrode and said second plane discharge electrode includes a transparent electrode and a bus electrode connected with said transparent electrode, said bus electrode having a lower resistivity than said transparent electrode, said bus electrodes of said first plane discharge electrodes are respectively provided straight above said row separation walls, and said second plane discharge electrodes are respectively provided straight above said rows of discharge cells.

2. The plasma display panel according to claim 1, wherein said first plane discharge electrode is a sustain electrode and said second plane discharge electrode is a scan electrode.

3. The plasma display panel according to claim 1, wherein said first plane discharge electrode is a scan electrode and said second plane discharge electrode is a sustain electrode.

4. The plasma display panel according to claim 1, wherein in an odd-numbered one of said plurality of electrode pairs, said first plane discharge electrode is a sustain electrode and said second plane discharge electrode is a scan electrode, and in an even-numbered one of said plurality of electrode pairs, said first plane discharge electrode is said scan electrode and said second plane discharge electrode is said sustain electrode.

5. The plasma display panel according to claim 1, wherein in an odd-numbered one of said plurality of electrode pairs, said first plane discharge electrode is a scan electrode and said second plane discharge electrode is a sustain electrode, and in an even-numbered one of said plurality of electrode pairs, said first plane discharge electrode is said sustain electrode and said second plane discharge electrode is said scan electrode.

6. The plasma display panel according to claim 1, wherein said transparent electrode of said first plane discharge electrode comprises:

a first portion provided straightly above said row of discharge cells; and a second portion connected to said bus electrode of said first plane discharge electrode and said first portion.

7. A method of driving of an AC 3-electrode plane discharge type plasma display including a plurality of electrode pairs of a first plane discharge electrode and a second plane discharge electrode;

a plurality of address electrodes formed on said back substrate to extend in a column direction so as to provide a plurality of discharge cells such that said discharge cells are respectively positioned at intersections between said electrode pairs and said address electrodes to form a matrix;

a plurality of row separation walls formed on said back substrate or said front substrate and said plurality of address electrodes to extend in said row direction such that each row of said discharge cells is defined by two of adjacent row separation walls; and a plurality of column separation walls formed on said back substrate or said front substrate to extend in said column direction such that each column of said discharge cells is defined by two of adjacent column separation walls;

wherein each of said first plane discharge electrode and said second plane discharge electrode includes a transparent electrode and a bus electrode connected with said transparent electrode, said bus electrode having a lower resistivity than said transparent electrode, said bus electrodes of said first plane discharge electrodes are respectively provided straight above said row separation walls, and said second plane discharge electrodes are respectively provided straight above said rows of discharge cells;

said method comprising: applying a common voltage signal to one of said first and second plane discharge electrodes of each of said electrode pairs in an address period, wherein said one electrode is determined based on an arrangement of said first and second plane discharge electrodes; and sequentially applying a write scan voltage signal to the other of said first and second plane discharge electrodes in said address period.

8. The method according to claim 7, wherein said applying comprises:

applying said common voltage signal to said first plane discharge electrodes, and said sequentially applying comprises:

sequentially applying said write scan voltage signal to all of said second plane discharge electrodes in said address period.

9. The method according to claim 7, wherein said applying comprises:

applying said common voltage signal to said second plane discharge electrodes, and said sequentially applying comprises:

sequentially applying said write scan voltage signal to all of said first plane discharge electrodes in said address period.

10. The method according to claim 7, wherein said applying comprises:

applying said common voltage signal to said second plane discharge electrodes of odd-numbered ones of said plurality of electrode pairs and said first plane discharge electrodes of even-numbered ones of said plurality of electrode pairs, and said sequentially applying comprises:

sequentially applying said write scan voltage signal to said first plane discharge electrodes of odd-numbered ones of said plurality of electrode pairs and then to said second plane discharge electrodes of even-numbered ones of said plurality of electrode pairs.

11. The method according to claim 7, wherein said applying comprises:

applying said common voltage signal to said first plane discharge electrodes of odd-numbered ones of said plurality of electrode pairs and said second plane discharge electrodes of even-numbered ones of said plurality of electrode pairs, and said sequentially applying comprises:

sequentially applying said write scan voltage signal to said first plane discharge electrodes of even-numbered ones of said plurality of electrode pairs and then to said second plane discharge electrodes of odd-numbered ones of said plurality of electrode pairs.

12. A plasma display apparatus of an AC 3-electrode plane discharge type, comprising:

a plasma display panel; and a drive unit which drives said plasma display panel, wherein said plasma display panel comprises:

a front substrate;

a back substrate;

a plurality of electrode pairs of plane discharge electrodes formed on said front substrate to extend to a row direction;

a plurality of address electrodes formed on said back substrate to extend in a column direction;

a plurality of row separation walls extending in said row direction;

a plurality of column separation walls extending in said column direction; and a plurality of discharge cells arranged in matrix, wherein each of said plurality of discharge cells is defined by adjacent two of said plurality of row separation walls and adjacent two of said plurality of column separation walls, each of rows of said plurality of discharge cells is associated with one of said plurality of electrode pairs of plane discharge electrodes and each of columns of said plurality of discharge cells is associated with one of said plurality of address electrodes, each of said plurality of electrode pairs comprises a first plane discharge electrode and a second plane discharge electrode, said first plane discharge electrode is provided above a corresponding one of said plurality of row separation walls and a corresponding one of said rows of said plurality of discharge cells, and said second plane discharge electrode is provided above said corresponding one of said rows of said plurality of discharge cells.

13. The plasma display apparatus according to claim 12, further comprising:

a control unit which controls said drive unit.

14. The plasma display apparatus according to claim 12, wherein each of said first plane discharge electrode and said second plane discharge electrode comprises a transparent electrode and a bus electrode connected with said transparent electrode, said bus electrode having a lower resistivity than said transparent electrode, said transparent electrode of said first plane discharge electrode is provided along said corresponding one of said plurality of row separation walls and said corresponding one of said rows of said plurality of discharge cells, said bus electrode of said first plane discharge electrode is provided straightly above said corresponding one of said rows of said plurality of discharge cells, said second plane discharge electrode is provided straightly above said corresponding one of said rows of said plurality of discharge cells.

15. The plasma display apparatus according to claim 12, wherein said first plane discharge electrode is a sustain electrode and said second plane discharge electrode is a scan electrode.

16. The plasma display apparatus according to claim 12, wherein said first plane discharge electrode is a scan electrode and said second plane discharge electrode is a sustain electrode.

17. The plasma display apparatus according to claim 12, wherein in an odd-numbered one of said plurality of electrode pairs, said first plane discharge electrode is a sustain electrode and said second plane discharge electrode is a scan electrode, and in an even-numbered one of said plurality of electrode pairs, said first plane discharge electrode is said scan electrode and said second plane discharge electrode is said sustain electrode.

18. The plasma display apparatus according to claim 12, wherein in an odd-numbered one of said plurality of electrode pairs, said first plane discharge electrode is a scan electrode and said second plane discharge electrode is a sustain electrode, and in an even-numbered one of said plurality of electrode pairs, said first plane discharge electrode is said sustain electrode and said second plane discharge electrode is said scan electrode.

19. The plasma display apparatus according to claim 12, wherein said transparent electrode of said first plane discharge electrode comprises:

a first portion provided straightly above said corresponding row of said plurality of discharge cells; and a second portion provided for each of said plurality of discharge cells of said corresponding one row to connect said bus electrode of said first plane discharge electrode and said first portion.

* * * * *